US007328987B2

(12) United States Patent
Katayama et al.

(10) Patent No.: US 7,328,987 B2
(45) Date of Patent: Feb. 12, 2008

(54) INK CARTRIDGE AND INKJET PRINTER

(75) Inventors: Naoki Katayama, Kariya (JP); Shota Iijima, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 310 days.

(21) Appl. No.: 10/951,680

(22) Filed: Sep. 29, 2004

(65) Prior Publication Data

US 2005/0088497 A1 Apr. 28, 2005

(30) Foreign Application Priority Data

Sep. 30, 2003 (JP) ..... 2003-340543
Jun. 28, 2004 (JP) ..... 2004-189527

(51) Int. Cl.
*B41J 2/175* (2006.01)

(52) U.S. Cl. ..... 347/86

(58) Field of Classification Search ..... 347/85–87
See application file for complete search history.

(56) References Cited

U.S. PATENT DOCUMENTS 5,500,663 A * 3/1996 Ujita et al. ..... 347/86
5,841,455 A * 11/1998 Tanaka et al. ..... 347/87
6,554,412 B1 * 4/2003 Seino et al. ..... 347/86
7,077,514 B2 * 7/2006 Inoue et al. ..... 347/86

FOREIGN PATENT DOCUMENTS

EP 1 464 502 A1 10/2004
JP A 2001-328279 11/2001

* cited by examiner

*Primary Examiner*—An H. Do
(74) *Attorney, Agent, or Firm*—Oliff & Berridge, PLC

(57) ABSTRACT

An ink cartridge has a cartridge body to which an ink supply pipe extending from an inkjet printer is detachably attached, and which has an ink storing space for storing an ink to be supplied to the inkjet printer via the ink supply pipe, and a valve mechanism that opens and closes both an ink path which, when the ink supply pipe is attached to the cartridge body, communicates with the ink supply pipe, and an atmospheric air path through which atmospheric air is introduced into the ink storing space, the valve mechanism including a valve member having a first opening-closing portion which is relatively movable with respect to the cartridge body, and which opens and closes the ink path and a second opening-closing portion which is relatively movable with respect to the cartridge body, and which opens and closes the atmospheric air path.

21 Claims, 29 Drawing Sheets

INK CARTRIDGE AND INKJET PRINTER

BACKGROUND OF THE INVENTION

1. Field of the Invention

The present invention relates to an ink cartridge, and also to an inkjet printer to which the ink cartridge is to be attached.

2. Description of the Related Art

An ink cartridge has an ink supplying portion which supplies an ink to an inkjet printer, and an atmospheric air introducing portion through which atmospheric air is introduced into the ink cartridge. In a state where the ink cartridge is attached to the inkjet printer, atmospheric air is introduced from the outside into the ink cartridge via the atmospheric air introducing portion, and, in place of the atmospheric air, the ink in the ink cartridge is supplied from the ink supplying portion to the inkjet printer. Usually, such an ink cartridge is configured so that, in a state where the ink cartridge is not attached to an inkjet printer, the ink does not leak from the ink supplying portion or the atmospheric air introducing portion.

FIG. 30 shows an example of such an ink cartridge. In the ink cartridge, plug members 103 made of synthetic rubber are attached to an ink supplying portion 101 and an atmospheric air introducing portion 102, respectively. When the ink cartridge 100 is attached to an inkjet printer, an ink supply pipe 104 and an atmospheric air introduction pipe 105 which are disposed on the inkjet printer, which are made of a metal, and which have a needle-like hollow shape, pierce through the two plug members 103, respectively. In an ink cartridge 110 shown in FIG. 31, an ink supplying portion 111 is configured in the same manner as that of the ink cartridge of FIG. 30, but an atmospheric air introducing portion 112 is configured so that an atmospheric air introducing port 115 formed in an upper end portion of the ink cartridge 110 is closed by a seal tape 116 or the like. When the ink cartridge 110 is attached to an inkjet printer, the operator peels off the seal tape 116 to expose the atmospheric air introducing port 115 to the outside. In another ink cartridge, valve mechanisms which can prevent ink leakage from occurring are disposed in an ink supplying portion and an atmospheric air introducing portion, respectively (for example, see JP-A-2001-328279 (FIG. 1)).

SUMMARY OF THE INVENTION

In the ink cartridges shown in FIGS. 30 and 31, the ink supply pipe and the atmospheric air introduction pipe which have a needle-like hollow shape, and which pierce through the synthetic rubber-made plug members in the attached state, are made of a metal. Particularly, the ink cartridge of FIG. 30 requires the two metal needles. This is disadvantageous from the viewpoint of the production cost of an inkjet printer. In the ink cartridge of FIG. 31, the atmospheric air introducing port is exposed to the outside in a state where the ink cartridge is detached from the inkjet printer in order to be replaced with a fresh one. In the case where, for example, the detached ink cartridge is placed on a desk, the ink remaining in the cartridge may leak from the atmospheric air introducing port to the outside depending on the placement direction of the cartridge. In the ink supplying portion, the plug member is once pierced by the ink supply pipe, and hence there is the possibility that a small amount of ink leaks from the plug member from which the ink supply pipe has been extracted.

In the ink cartridge disclosed in JP-A-2001-328279, since the valve mechanisms are disposed respectively in the ink supplying portion and the atmospheric air introducing portion, the number of parts is increased, and the structure is complicated, whereby the production cost of the ink cartridge is increased. Also, in the ink cartridge of FIG. 31, the user must peel off the seal tape to open the atmospheric air introducing port. When this operation is not conducted, the ink cannot be correctly supplied. In the ink cartridge of JP-A-2001-328279, the atmospheric air introducing port is closed by a check valve, and hence the atmospheric air introducing port does not fail to be opened. However, in the case where, when the atmospheric air introducing port is opened, the pressure difference between the exterior and interior of the ink cartridge is equal to or larger than a predetermined value, the pressure of the ink in the cartridge pulsates, and hence the pressure of the ink supplied to the inkjet head becomes unstable.

It is an object of the invention to surely prevent ink leakage from occurring in a state where an ink cartridge is detached from an inkjet printer, simplify a structure for preventing such ink leakage from occurring, and reduce the production cost. It is another object of the invention to surely open an ink supplying path and an atmospheric air introducing path in conjunction with an operation of attaching an ink cartridge.

According to an aspect of the invention, there is provided an ink cartridge including: a cartridge body which has an ink storing space for storing an ink; and a valve mechanism that opens and closes both an ink path which, when the ink supply pipe is attached to the cartridge body, communicates with the ink supply pipe, and an atmospheric air path through which atmospheric air is introduced into the ink storing space, the valve mechanism including a valve member having: a first opening-closing portion which is relatively movable with respect to the cartridge body, and which opens and closes the ink path; and a second opening-closing portion which is relatively movable with respect to the cartridge body, and which opens and closes the atmospheric air path; wherein when the ink supply pipe is attached to the cartridge body, in conjunction with the attaching operation, the first opening-closing portion opens the ink path, and the second opening-closing portion opens the atmospheric air path.

When the ink cartridge is attached to an inkjet printer, the ink supply pipe disposed on the inkjet printer is attached to the cartridge body. In the valve mechanism, the first opening-closing portion opens the ink path in conjunction of the operation of attaching the ink supply pipe, and the second opening-closing portion opens the atmospheric air path.

In conjunction with the operation of attaching the ink supply pipe, therefore, both the ink path and the atmospheric air path can be opened by the single valve mechanism. As a result, the number of parts can be reduced, and the structure can be simplified, so that the production cost can be lowered. Unlike the case of the conventional ink cartridge, the ink supply pipe is not required to pierce through a plug member for sealing. Therefore, the ink supply pipe is not always necessary to be made of a metal, and can be configured by an economical material which is relatively soft, such as a synthetic resin.

According to another aspect of the invention, there is provided an inkjet printer including: an ink supply pipe; an ink cartridge including: a cartridge body to which the ink supply pipe is detachably attached, and which has an ink storing space for storing an ink to be supplied to the inkjet printer via the ink supply pipe; and a valve mechanism that opens and closes both an ink path which, when the ink supply pipe is attached to the cartridge body, communicates with the ink supply pipe, and an atmospheric air path through which atmospheric air is introduced into the ink storing space, the valve mechanism including a valve member having: a first opening-closing portion which is relatively movable with respect to the cartridge body, and which opens and closes the ink path; and a second opening-closing portion which is relatively movable with respect to the cartridge body, and which opens and closes the atmospheric air path; in which when the ink supply pipe is attached to the cartridge body, in conjunction with the attaching operation, the first opening-closing portion opens the ink path, and the second opening-closing portion opens the atmospheric air path; and an operating portion which, in conjunction with an operation of attaching the ink supply pipe to the cartridge body, butts against the second opening-closing portion to move the second opening-closing portion to a position where the atmospheric air path is opened. When, in conjunction with an operation of attaching the ink supply pipe, the second opening-closing portion is moved by the operating portion which butts against the second opening-closing portion, therefore, the atmospheric air path can be easily opened.

BRIEF DESCRIPTION OF THE DRAWINGS

The present invention may be more readily described with reference to the accompanying drawings.

DETAILED DESCRIPTION OF THE PREFERRED EMBODIMENTS

A first embodiment of the invention will be described. In the first embodiment, the invention is applied to an ink cartridge which is to be attached to an inkjet printer.

First, an inkjet printer 1 will be briefly described.

Figure 1:
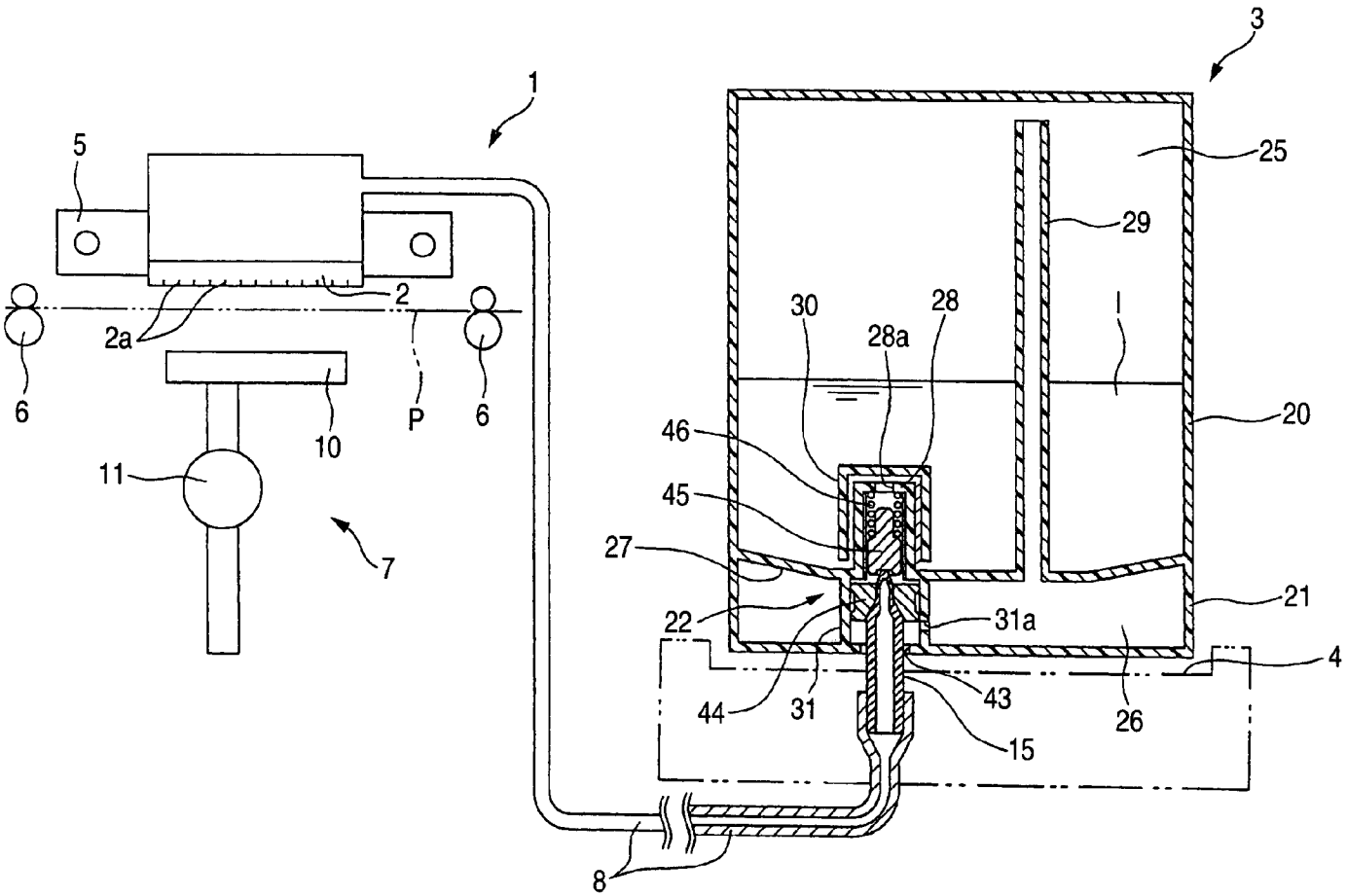
FIG. 1 is a diagram of an ink cartridge and an inkjet printer in a first embodiment of the invention.

As shown in FIG. 1, the inkjet printer 1 has: an ink-jet head 2 having nozzles 2*a* from which an ink I is ejected toward a recording sheet P; a carriage 5 which linearly moves the ink-jet head 2 in one direction in a reciprocal manner; a transporting mechanism 6 which transports the recording sheet P; a purging device 7 which sucks air bubbles and the thickened ink I in the inkjet head 2; and an attaching portion 4 to which an ink cartridge 3 is to be detachably attached. An ink supply pipe 15 is fixed to the attaching portion 4 in a state where the ink supply pipe protrudes upward.

The ink I in the ink cartridge 3 is supplied to the nozzles 2*a* of the inkjet head 2 via an ink supply pipe 15. While the inkjet head 2 is reciprocally moved by the carriage 5 in the direction perpendicular to the plane in FIG. 1, the ink I is ejected from the nozzles 2*a* toward the recording sheet P which is transported by the transporting mechanism 6 in a lateral direction in FIG. 1, thereby conducting a printing process on the recording sheet P.

The purging device 7 has: a purge cap 10 which is movable in approaching/separating directions to an ink ejection surface, and which can cover the ink ejection surface of the inkjet head 2; and a suction pump 11 which sucks the ink I from the nozzles 2*a*. When the inkjet head 2 is outside the printable range where the printing process can be conducted on the recording sheet P, air bubbles entering the inkjet head 2, and the ink I which is thickened as a result of evaporation of water can be sucked from the nozzles 2*a* by the suction pump 11.

Next, the ink cartridge 3 will be described.

As shown in FIG. 1, the ink cartridge 3 has: a cartridge body 20 having an ink storing space 25 which stores the ink I; a cover member 21 which covers the lower end of the cartridge body 20; and a valve mechanism 22 that can open and close both an ink path 23 (see FIGS. 4 and 5) through which the ink is supplied to the inkjet head 2, and an atmospheric air path 24 (see FIG. 5) through which atmospheric air is introduced into the ink storing space 25.

Figure 2:
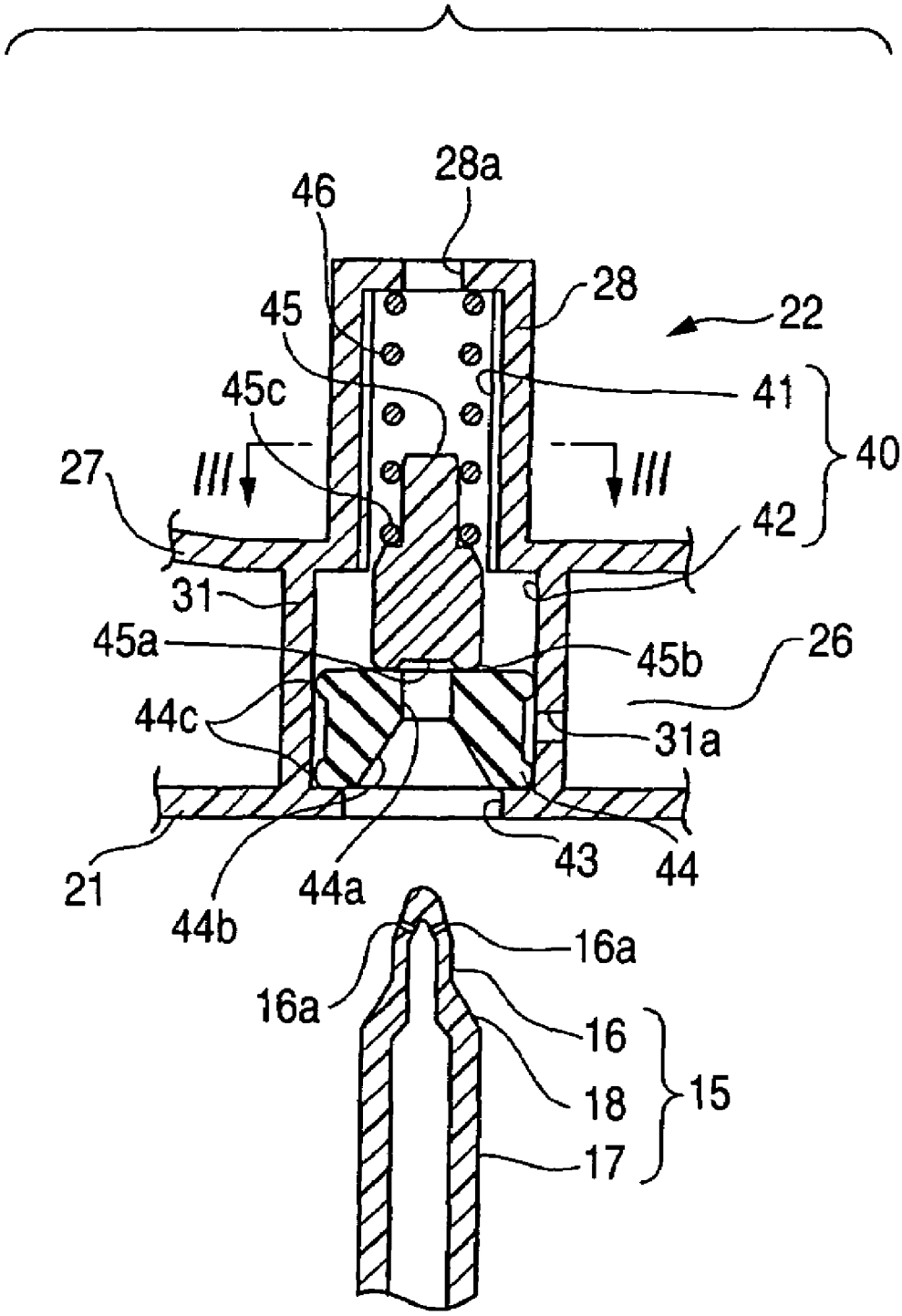
FIG. 2 is an enlarged view of a valve mechanism before the ink cartridge is attached.

As shown in FIG. 2, the ink supply pipe 15 is formed into a hollow needle-like shape by a synthetic resin, and the inner path of the ink supply pipe 15 is connected via a supply tube 8 to the inkjet head 2. The ink supply pipe 15 has a small-diameter portion 16 which is on the side of the tip end, and a large-diameter portion 17. A tapered portion 18 through which the small-diameter portion 16 is continuously connected to the large-diameter portion 17 is disposed integrally on an outer peripheral portion of the ink supply pipe 15. In the small-diameter portion 16, a plurality of ink inflow ports 16*a* which allow the inner path of the ink supply pipe 15 to communicate with the outside are formed.

As shown in FIG. 1, the cartridge body 20 is formed by, for example, a synthetic resin, and a partition wall 27 is formed in the cartridge body 20 to vertically separate the ink storing space 25 which is substantially hermetically sealed to store the ink I, from an atmospheric air introducing space 26 into which atmospheric air is introduced from the outside. Two tubes 28, 29 which elongate toward the ink storing space 25, and which have different lengths are formed integrally with the partition wall 27. A small-diameter hole 41 (see FIG. 2) which houses a valve element 45 that will be described later is formed in the shorter tube 28, and an ink introducing hole 28*a* through which the ink I in the ink storing space 25 is introduced into the small-diameter hole 41 is formed in an upper wall portion of the tube 28. A tubular member 30 which covers a large part of the tube 28, and which is downward opened is put from the upper side on the tube 28. The tubular member 30 guides the ink I remaining in the vicinity of the bottom of the ink storing space 25 to the ink introducing hole 28*a* of the tube 28, in order to use up the ink I in the ink storing space 25. By contrast, the longer tube 29 elongates to the vicinity of a top plate of the cartridge body 20, and guides the atmospheric air in the atmospheric air introducing space 26 to an upper portion of the ink storing space 25.

Also a tube 31 which elongates toward the atmospheric air introducing space 26 is formed on the partition wall 27. In the tube 31, the internal space is formed so as to have a diameter that is larger than that of the above-mentioned tube 28 which elongates toward the ink storing space 25. A large-diameter hole 42 (see FIG. 2) which houses a tubular member 44 that will be described later is formed in the tube 31. An atmospheric air communicating hole 31*a* through which the large-diameter hole 42 communicates with the atmospheric air introducing space 26 is formed in a side portion of the tube 31.

The cover member 21 is formed by, for example, a synthetic resin, and fixed to a lower end portion of the cartridge body 20 by welding or the like. The atmospheric air introducing space 26 is formed by the cover member 21 and the partition wall 27. An insertion hole 43 which communicates with a valve housing hole 40 that will be described later, and into which the ink supply pipe 15 is to be inserted from the outside is formed in the cover member 21.

As shown in FIG. 2, the valve mechanism 22 has: the valve housing hole 40 which is formed in the cartridge body 20, and which constitutes parts of the ink path 23 and the atmospheric air path 24; a tubular member 44 (second opening-closing portion) which is attached into the valve housing hole 40 so as to be slidable in the vertical directions (the insertion and counter-insertion directions of the ink supply pipe 15), and which has a through hole 44*a*, the ink supply pipe 15 being to be passed through the through hole; the valve element 45 (first opening-closing portion) which is disposed in the valve housing hole 40 so as to be movable in the vertical directions to be buttable and approachable/separable with respect to the tubular member 44, the valve element closing the through hole 44*a* in a state where the valve element butts against the tubular member 44; and a coil spring 46 (urging member) which urges the valve element 45 in a downward direction (in the direction along which the ink path 23 and the atmospheric air path 24 are closed). The tubular member 44 and the valve element 45 are juxtaposed in the insertion direction of the ink supply pipe 15. The tubular member 44 and the valve element 45 function as a valve member.

The valve housing hole 40 includes the small-diameter hole 41 formed in the tube 28, and the large-diameter hole 42 which communicates with the lower end of the small-diameter hole 41, and which is formed in the tube 31. The insertion hole 43 formed in the cover member 21 communicates with the lower end of the large-diameter hole 42. The lower end of the valve housing hole 40 is opened to the outside through the insertion hole 43 so that the ink supply pipe 15 can be inserted into the valve housing hole 40 from the lower side. The diameter of the insertion hole 43 is smaller than that of the large-diameter hole 42, and the tubular member 44 attached to the large-diameter hole 42 is engaged with the cover member 21 so as not to escape from the large-diameter hole 42. The ink introducing hole 28*a* and the atmospheric air communicating hole 31*a* which have been described above are disposed on the side of the ink storing space 25 with respect to the lower end of the valve housing hole 40. The valve element 45 and the tubular member 44 are placed in the small-diameter hole 41 and the large-diameter hole 42 so as to correspond to the ink introducing hole 28*a* and the atmospheric air communicating hole 31*a*, respectively.

The tubular member 44 is an elastic member made of, for example, synthetic rubber, and configured so as to, in the large-diameter hole 42, be movable in the axial direction between an atmospheric air closing position (see FIGS. 2 and 4) where the side face of the tubular member 44 is opposed to the atmospheric air communicating hole 31*a* to close the hole, and a position where the side face is not opposed to the atmospheric air communicating hole 31*a*, or an atmospheric air opening position (see FIGS. 5 and 6) where the atmospheric air communicating hole 31*a* is opened. Two sealing portions 44*c* which annularly protrude in an outer radial direction to be in sliding contact with the inner wall of the large-diameter hole 42 are disposed integrally on outer peripheral portions of upper and lower end portions of the tubular member 44, respectively. Because of the sealing portions 44*c*, the tubular member 44 and the large-diameter hole 42 are closely contacted with each other without forming a gap, and atmospheric air is prevented from entering the atmospheric air introducing space 26 through the atmospheric air communicating hole 31*a* in a state where the tubular member 44 is in the atmospheric air closing position. The through hole 44*a* is formed in a middle portion of the upper half of the tubular member 44. A tapered pressing face 44*b* (second pressing face) which is continuous to the lower end of the through hole 44*a* is formed on the inner side of the lower half of the tubular member 44.

Figure 4:
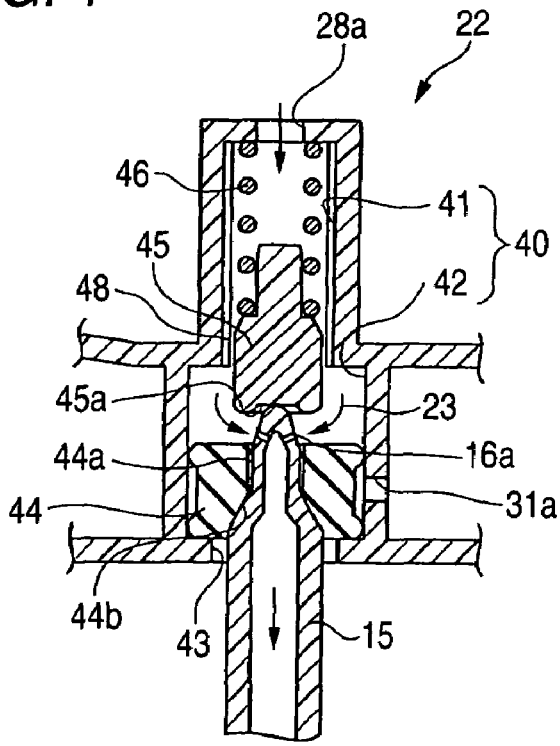
FIG. 4 is an enlarged view of the valve mechanism during an operation of attaching the ink cartridge.
Figure 5:
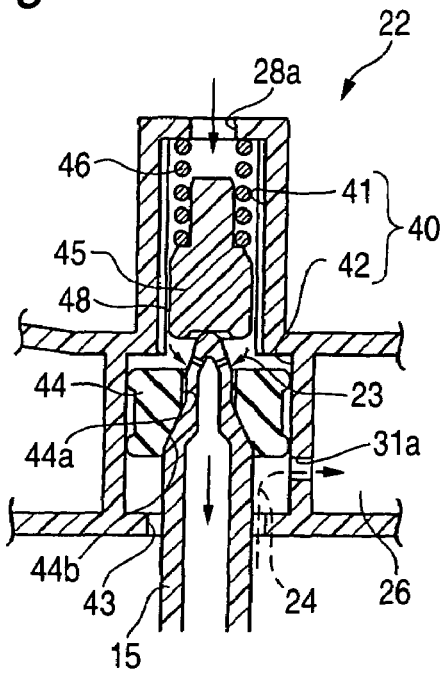
FIG. 5 is an enlarged view of the valve mechanism in a state where the operation of attaching the ink cartridge is completed.

When the ink supply pipe 15 is inserted into the cartridge body 20, as shown in FIGS. 4 and 5, the small-diameter portion 16 of the ink supply pipe 15 is passed through the through hole 44*a*, and the tapered portion 18 is then in close contact with the pressing face 44*b*. The pressing face 44*b* of the tubular member 44 is pressed upward (in the direction along which the atmospheric air path 24 is opened) by the ink supply pipe 15, whereby the tubular member 44 is moved from the atmospheric air closing position to the atmospheric air opening position in a state where the tubular member is in close contact with the outer periphery of the large-diameter portion 17. The tapered portion 18 of the ink supply pipe 15 functions as an operating portion.

Figure 3:
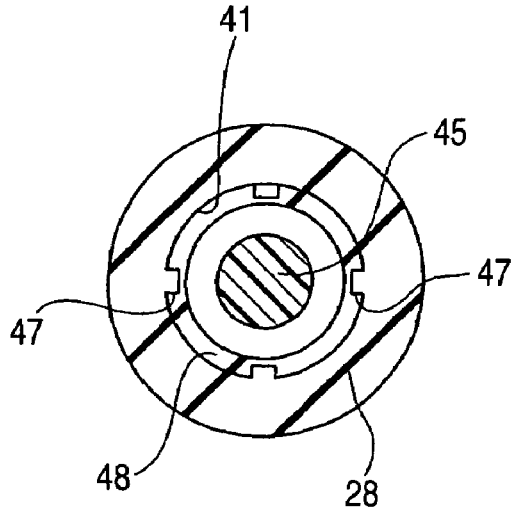
FIG. 3 is a sectional view taken along the line III-III in FIG. 2.

The valve element 45 is formed by, for example, a synthetic resin, and attached to the small-diameter hole 41 so as to be vertically movable. As shown in FIG. 3, plural (for example, four) guiding portions 47 which vertical elongate, and which inward protrude are formed in plural (for example, four) places arranged in the circumferential direction. The valve element 45 is configured so that, in the small-diameter portion 16, the valve element is guided by the plural guiding portions 47 so as to be surely vertically moved. Gaps 48 between the guiding portions 47 constitute a part of the ink path 23 which communicates with the interior of the cartridge body 20. A pressing face 45*a* (first pressing face) against which the small-diameter portion 16 of the ink supply pipe 15 that has been passed through the through hole 44*a* of the tubular member 44 is to butt and upward pressed by the small-diameter portion 16 is formed on the lower end face of the valve element 45. Also an annular sealing portion 45*b* which downward protrudes so as to surround the pressing face 45*a* is formed on the lower end face of the valve element 45. In the sealing portion 45*b*, the lower end face of the valve element 45 can butt against the upper end face of the tubular member 44. In a state where the valve element 45 butts against the tubular member 44, the through hole 44*a* is closed. In this state, the ink I is prevented from leaking from the through hole 44*a*, by the sealing portion 45*b*. A stepped spring receiving portion 45*c* which receives the coil spring 46 is formed in an upper end side portion of the valve element 45.

The coil spring 46 is placed between the spring receiving portion 45*c* of the valve element 45 and the upper end face of the tube 28, and downward urges the valve element 45.

Next, the opening and closing operations of the valve mechanism 22 which are conducted during the processes of attaching and detaching the ink cartridge 3 will be described.

As shown in FIG. 2, in a state where the ink cartridge 3 has not yet been attached to the inkjet printer 1, first, the valve element 45 is downward urged by the urging force of the coil spring 46 to butt against the tubular member 44, so that the through hole 44*a* of the tubular member 44 is closed by the valve element 45. Moreover, also the tubular member 44 is downward urged via the valve element 45 by the urging force of the coil spring 46, and engagingly held by the cover member 21, so that the tubular member 44 is in the atmospheric air closing position where the atmospheric air communicating hole 31*a* is closed.

When the ink cartridge 3 is attached to the inkjet printer 1, the ink supply pipe 15 is inserted into the cartridge body 20 through the insertion hole 43. The ink cartridge 3 which is to be attached is relatively moved with respect to the ink supply pipe 15, whereby the ink supply pipe 15 is inserted into the cartridge body 20. The distance between the upper end of the tapered portion 18 of the ink supply pipe 15 and the upper end of the small-diameter portion 16 is set to be longer than that between the pressing face 44*b* of the tubular member 44 and the upper face of the tubular member 44. As shown in FIG. 4, therefore, the small-diameter portion 16 on the tip end side of the ink supply pipe 15 is first passed through the through hole 44*a* of the tubular member 44, the tip end of the ink supply pipe 15 butts against the pressing face 45*a* of the valve element 45, the valve element 45 is pushed up by the ink supply pipe 15 against the urging force of the coil spring 46 to be upward moved, and the valve element 45 is separated from the tubular member 44. As indicated by the arrows in FIG. 4, therefore, the ink path 23 which elongates from the ink introducing hole 28*a* to the portion below the pressing face 45*a* via the small-diameter hole 41, the gaps 48, and the large-diameter hole 42 is opened. At this time, the ink inflow ports 16*a* formed in the small-diameter portion 16 of the ink supply pipe 15 which upward protrudes from the through hole 44*a* communicate with the interior of the large-diameter hole 42. Since the ink path 23 communicates with the ink supply pipe 15 in a state where the pressing face 44*b* of the tubular member 44 is in close contact with the tapered portion 18 of the ink supply pipe 15, the ink is prevented from downward flowing out along the outer peripheral face of the ink supply pipe 15 when the ink is supplied to the ink supply pipe 15.

When the ink supply pipe 15 is further inserted, as shown in FIG. 5, the tapered portion 18 of the ink supply pipe 15 presses the pressing face 44*b* of the tubular member 44 to upward move integrally the tubular member 44 and the valve element 45 against the urging force of the coil spring 46. At this time, the tubular member 44 is moved from the atmospheric air closing position of FIG. 4 to the atmospheric air opening position of FIG. 5, and hence the atmospheric air communicating hole 31*a* communicates with the large-diameter hole 42. As indicated by the broken arrow in FIG. 5, therefore, the atmospheric air path 24 which elongates from the insertion hole 43 to the atmospheric air communicating hole 31*a* and the atmospheric air introducing space 26 is opened, and atmospheric air is introduced via the tube 29 into the ink storing space 25 (see FIG. 1). As a result, as indicated by the solid lines in FIG. 5, the ink in the ink storing space 25 is supplied to the inkjet head 2 via the ink path 23 and the ink supply pipe 15. In the ink cartridge 3 of the first embodiment, when the ink supply pipe 15 is inserted, the valve element 45 is upward moved in conjunction with the inserting operation to open the ink path 23, and also the tubular member 44 is then upward moved to open the atmospheric air path 24.

Figure 6:
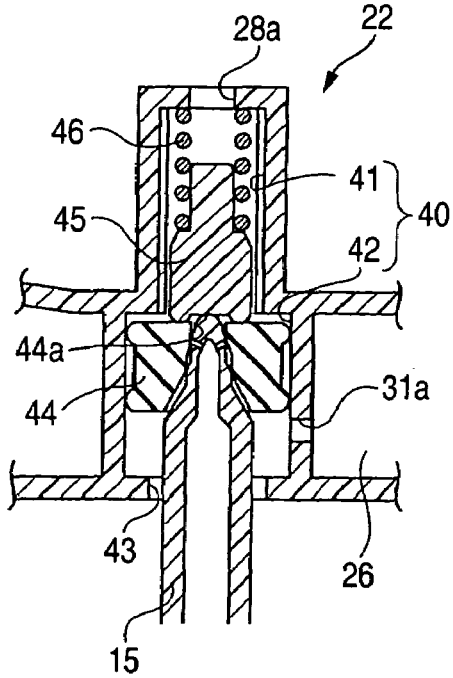
FIG. 6 is an enlarged view of the valve mechanism during an operation of detaching the ink cartridge.

By contrast, when the ink cartridge 3 is detached from the inkjet printer 1, the ink supply pipe 15 is extracted from the cartridge body 20. As shown in FIG. 6, first, the valve element 45 is downward urged by the urging force of the coil spring 46 to butt against the tubular member 44, and the ink path 23 is closed. The valve element 45 and the tubular member 44 are integrally downward moved by the urging force of the coil spring 46, the tubular member 44 is moved from the atmospheric air opening position of FIG. 5 to the atmospheric air closing position of FIG. 2 where the tubular member is engaging held by the cover member 21, and the atmospheric air path 24 is closed. In the case where the ink cartridge 3 is detached, when the valve member 45 and the tubular member 44 are downward moved during a period from the timing when the ink path 23 is closed to that when the atmospheric air path 24 is closed, the ink I inflows from the ink storing space 25 into the valve housing hole 40 via the ink introducing hole 28*a*, and hence the pressure in the ink storing space 25 is slightly lowered. Immediately before the atmospheric air path 24 is closed, the external atmospheric air is sucked into the atmospheric air introducing space 26 via the insertion hole 43 and the atmospheric air communicating hole 31*a*. Therefore, a small amount of the ink I which outflows into the large-diameter hole 42 together with the extracted ink supply pipe 15 is sucked together with the atmospheric air into the atmospheric air introducing space 26. Consequently, the ink I can be prevented from adhering to the vicinity of the insertion hole 43, so that contamination of the hands of the operator, and leakage of the ink I in the case where the detached ink cartridge 3 is placed on a desk or the like can be prevented from occurring.

In the above-described ink cartridge 3, in conjunction with the operations of inserting and extracting the ink supply pipe 15, both the ink path 23 and the atmospheric air path 24 can be opened and closed by the single valve mechanism 22. Therefore, the number of parts can be reduced, and the structure can be simplified, so that the production cost can be lowered.

Figure 30:
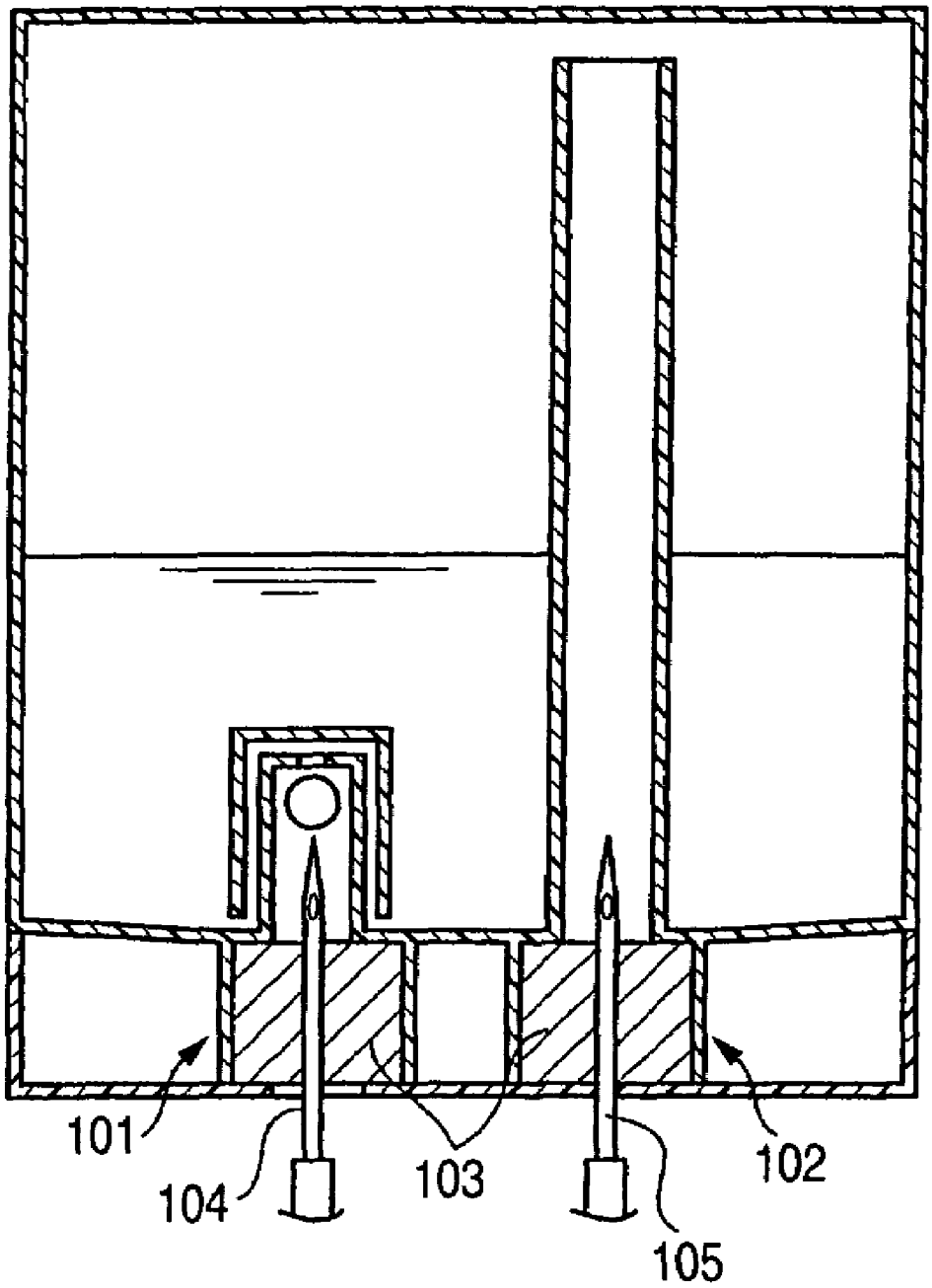
FIG. 30 is a sectional view of a conventional ink cartridge.
Figure 31:
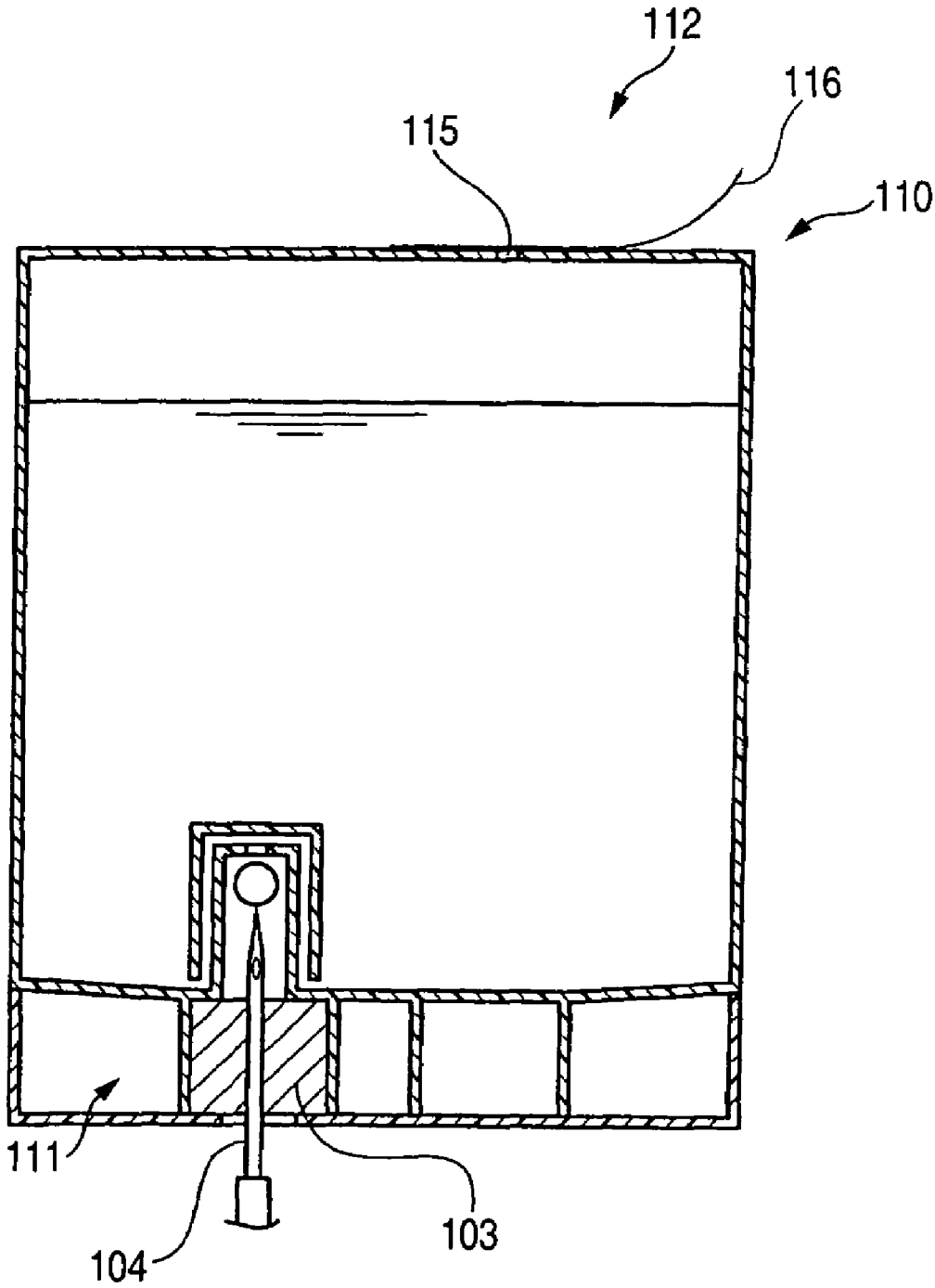
FIG. 31 is a sectional view of another conventional ink cartridge.

The ink supply pipe 15 is requested only to have a strength which enables the ink supply pipe to push up the valve element 45 and the tubular member 44 against the urging force of the coil spring 46. Therefore, the ink supply pipe is not requested to have a strength which enables the ink supply pipe to pierce through a plug member 103 of the conventional ink cartridge (see FIGS. 30 and 31). Consequently, the ink supply pipe 15 can be configured by a material which is relatively soft, such as a synthetic resin. This is advantageous from the viewpoint of the cost of parts.

In the ink cartridge 3, the first and second opening-closing portions 45, 44 of the valve member are arranged in a predetermined direction that is coincident with a direction along which the ink supply pipe is attached, and, in accordance with an operation of attaching the ink supply pipe, the first and second opening-closing portions 45, 44 are operated sequentially or integrally in the predetermined direction. In conjunction of the operation of attaching the ink supply pipe, therefore, the first and second opening-closing portions 45, 44 are operated sequentially or integrally in the attachment direction, and the ink path and the atmospheric air path are opened.

In the ink cartridge 3, the valve mechanism has a valve housing hole 40 which is formed in the cartridge body 20, and which constitutes parts of the ink path and the atmospheric air path, one end of the valve housing hole 40 is opened to an outside to enable the ink supply pipe 15 to be inserted, the valve member is housed in the valve housing hole 40 to be movable in an insertion direction of the ink supply pipe 15, an ink introduction hole and an atmospheric air communicating hole which allow an interior of the valve housing hole and the ink storing space to communicate with each other are disposed on a side of the ink storing space with respect to the one end of the valve housing hole 40, and the first and second opening-closing portions 45, 44 of the valve member are placed in correspondence with the ink introduction hole and the atmospheric air communicating hole, respectively.

In the ink cartridge 3, when the ink supply pipe 15 is inserted into the valve housing hole 40 from the opened one end of the valve housing hole, the valve member is moved in the insertion direction of the ink supply pipe in accordance with the operation of inserting the ink supply pipe, and the ink introduction hole and the atmospheric air communicating hole are opened by the first and second opening-closing portions, respectively. Therefore, atmospheric air is introduced into the ink storing space through the atmospheric air communicating hole, and the ink is supplied from the ink storing space into the ink supply pipe through the ink introduction hole.

In the ink cartridge 3, the valve member has an internal space into which the ink supply pipe is to be inserted, and, when the ink supply pipe 15 is inserted into the internal space, the valve member is in close contact with an outer periphery of the ink supply pipe and causes the ink path to communicate with the ink supply pipe. As described above, the ink path communicates with the ink supply pipe in a state where the valve member is in close contact with the outer periphery of the ink supply pipe. When the ink is supplied from the ink path into the ink supply pipe, therefore, the ink can be prevented from flowing to the outside.

In the ink cartridge 3, the first and second opening-closing portions 45, 44 are configured by separate components, respectively, the valve mechanism has an urging member 46 for urging the first and second opening-closing portions 45, 44 in a direction along which the ink path and the atmospheric air path are closed, in a state where the ink supply pipe 15 is not inserted into the valve housing hole 40, the first opening-closing portion 45 is urged by the urging member 46 to butt against the second opening-closing portion 44, thereby closing the ink path, and the second opening-closing portion 44 is urged by the urging member 46 to close the atmospheric air path, and, in conjunction with the operation of inserting the ink supply pipe 15 into the valve housing hole 40, the second opening-closing portion 44 is moved to open the atmospheric air path, and the first opening-closing portion 45 is separated from the second opening-closing portion 44 to cause the ink path to communicate with the ink supply pipe.

In the ink cartridge 3, the first and second opening-closing portions 45, 44 are configured by separate components, respectively. In a state where the ink supply pipe is not inserted into the valve housing hole 40, the first opening-closing portion is urged by the urging member 46 to butt against the second opening-closing portion, and the ink path is closed by the first opening-closing portion. Moreover, also the second opening-closing portion is urged by the urging member 46, and the atmospheric air path is closed by the second opening-closing portion. When the ink supply pipe 15 is inserted into the valve housing hole 40, the second opening-closing portion is moved in the valve housing hole to open the atmospheric air path in conjunction with the operation of inserting the ink supply pipe, and the first opening-closing portion is separated from the second opening-closing portion, so that the ink path and the ink supply pipe communicate with each other. Therefore, the ink in the ink storing space is supplied into the ink supply pipe 15 through the ink path.

In the ink cartridge 3, the second opening-closing portion 44 has a through hole into which the ink supply pipe 15 is to be inserted, in a state where the ink supply pipe is not inserted into the through hole, the first opening-closing portion 45 is urged by the urging member to butt against the second opening-closing portion, thereby closing the through hole, and, in conjunction with an operation of inserting the ink supply pipe into the through hole, the first opening-closing portion is separated from the second opening-closing portion to cause the ink path to communicate with the ink supply pipe. When the ink supply pipe is inserted into the through hole of the second opening-closing portion, therefore, the first opening-closing portion is separated from the second opening-closing portion in conjunction with the inserting operation, whereby the through hole is opened and the ink path communicates with the ink supply pipe.

In the ink cartridge 3, when the ink supply pipe 15 is extracted from the through hole, the first opening-closing portion 45 is caused by the urging member to butt against the second opening-closing portion 44, thereby closing the through hole, and the first and second opening-closing portions are then integrally moved to close the atmospheric air path. When the ink supply pipe is extracted, therefore, the first and second opening-closing portions are moved integrally with each other during a period from a timing when the first opening-closing portion butts against the second opening-closing portion to close the ink path to that when the atmospheric air path is closed. Consequently, the ink of an amount corresponding to the movement of the first and second opening-closing portions flows from the cartridge body into the valve housing hole. As a result, the pressure in the cartridge body is slightly lowered, and the ink which adheres to the interiors of the ink supply pipe and the valve housing hole is sucked into the atmospheric air path immediately before the atmospheric air path is closed. Therefore, the ink hardly outflows to the exterior of the valve housing hole.

In the ink cartridge 3, the first opening-closing portion 45 has a first pressing face which is to be pressed by a tip end portion of the ink supply pipe 15 in a direction along which the ink path is opened, and the second opening-closing portion 44 has a second pressing face which, in conjunction with the operation of attaching the ink supply pipe, is to be pressed in a direction along which the atmospheric air path is opened. When the ink supply pipe 15 is attached to the cartridge body, therefore, the first pressing face of the first opening-closing portion is pressed by the tip end portion of the ink supply pipe, and the first opening-closing portion opens the ink path. In conjunction with the operation of attaching the ink supply pipe, then, the second pressing face of the second opening-closing portion is pressed, and the second opening-closing portion opens the atmospheric air path.

In the inkjet printer 1, the operating portion is formed integrally with an outer peripheral portion of the ink supply pipe 15. Therefore, it is not required to produce the operating portion as a component which is different from the ink supply pipe, so that the operating portion can be easily formed integrally with the ink supply pipe.

Next, modifications in which the first embodiment is variously modified will be described. The components which are configured in the same manner as those of the embodiment are denoted by the same reference numerals, and their description is often omitted.

As the urging member which downward urges the valve element 45 and the tubular member 44, another spring member such as a disc spring may be used in place of the coil spring 46 in the embodiment. Alternatively, the urging member may be made of elastic synthetic rubber or the like.

Figure 7:
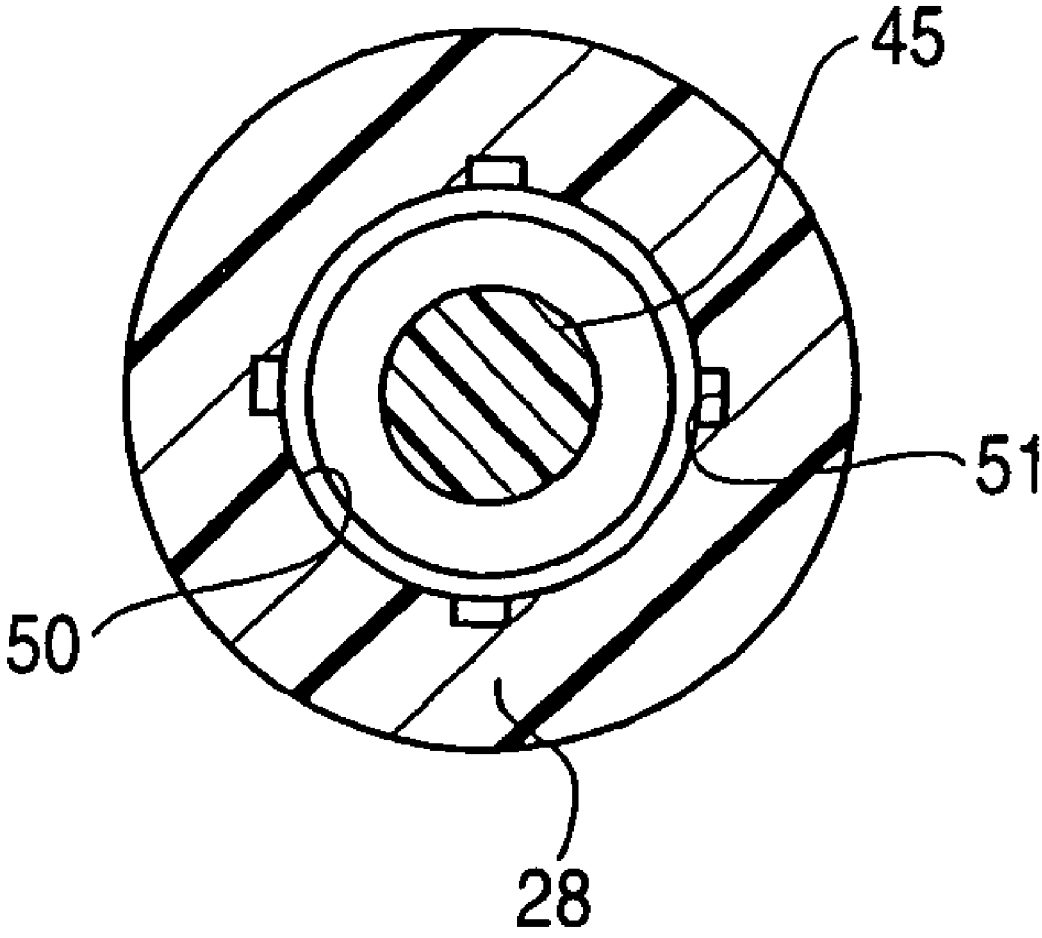
FIG. 7 is a view of a modification of the first embodiment and corresponding to FIG. 3.

The guiding portion which guides the valve element 45 to move in the small-diameter hole 41 is not limited to the guiding portions 47 (see FIG. 3) of the first embodiment. As shown in FIG. 7, for example, an inner face 50 of the small-diameter hole 41 may function as the guiding portion, and grooves 51 formed in the inner face 50 may constitute a part of the ink path 23. Alternatively, the guiding portions 47 or the grooves 51 may be disposed in the outer periphery of the valve element 45.

The operation of inserting or extracting the ink supply pipe 15 into the cartridge body 20 via the insertion hole 43 is not limited to insertion or extraction which is conducted by moving the ink cartridge 3 with respect to the fixed ink supply pipe 15. The operation of inserting or extracting may be conducted by moving the ink supply pipe 15 with respect to the fixed ink cartridge 3.

Modifications (Modifications A to D) of the first embodiment in which the configuration of the valve mechanism is modified will be described.

(Modification A)

Figure 8:
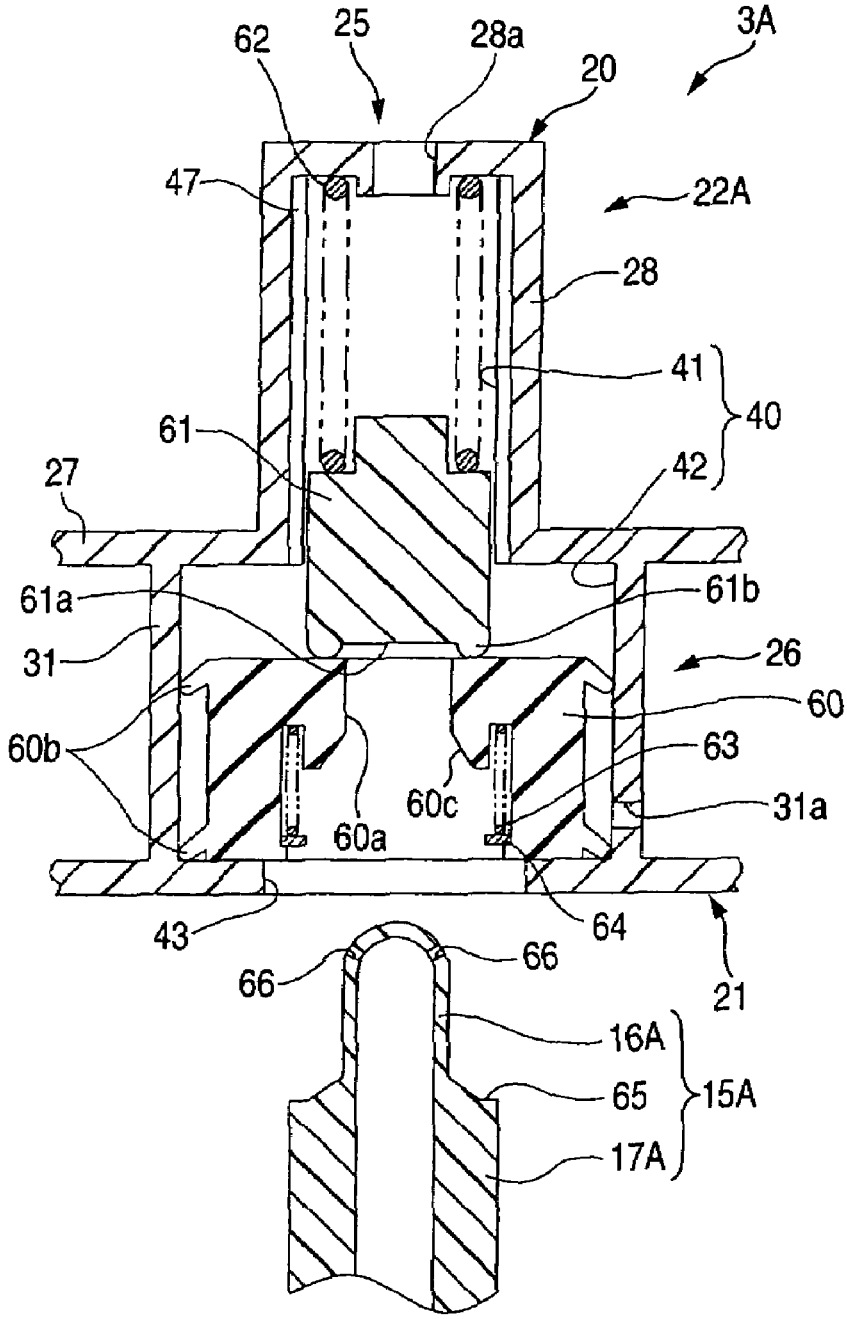
FIG. 8 is an enlarged view of a valve mechanism before an ink cartridge of Modification A is attached.
Figure 9:
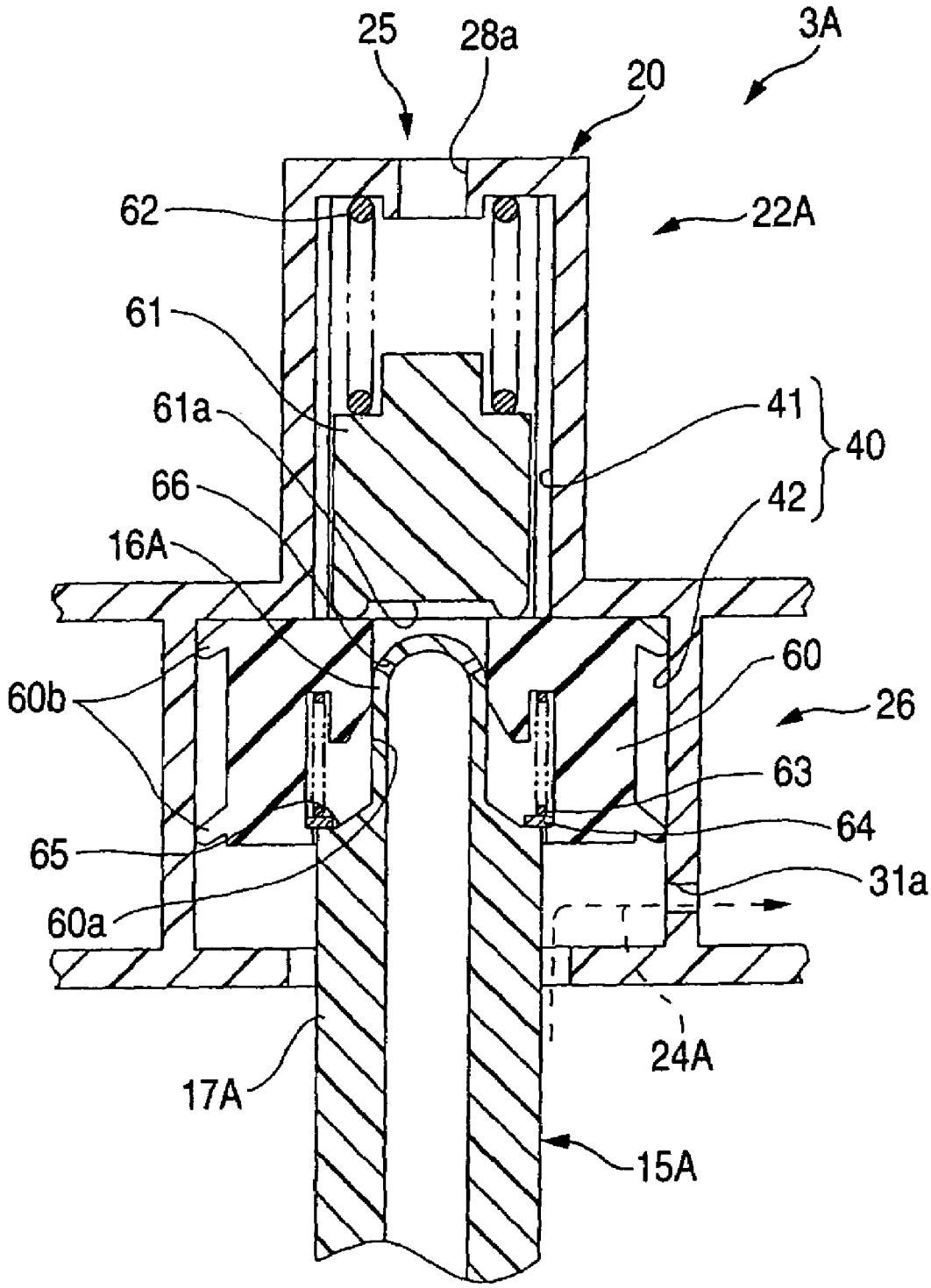
FIG. 9 is an enlarged view of the valve mechanism during an operation of attaching the ink cartridge.
Figure 10:
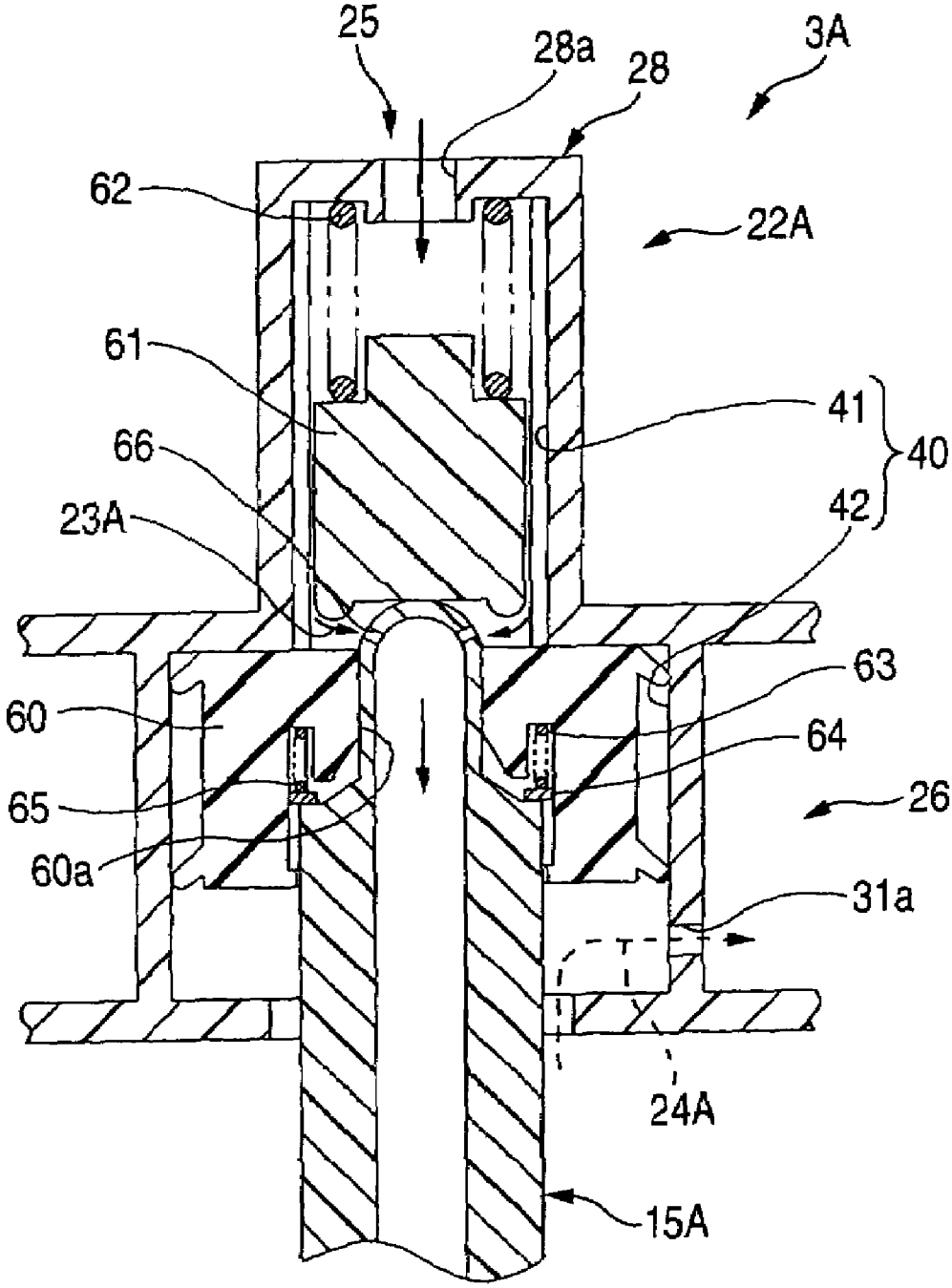
FIG. 10 is an enlarged view of the valve mechanism in a state where the operation of attaching the ink cartridge is completed.

As shown in FIGS. 8 to 10, a valve mechanism 22A of an ink cartridge 3A of Modification A has: a valve housing hole 40 which is formed in the cartridge body 20, and which constitutes parts of an ink path 23A (see FIG. 10) and an atmospheric air path 24A (see FIGS. 9 and 10); a tubular member 60 (second opening-closing portion) which is attached into the valve housing hole 40 so as to be slidable in the vertical directions, and which has a through hole 60*a*, an ink supply pipe 15A being to be passed through the through hole; a valve element 61 (first opening-closing portion) which is disposed in the valve housing hole 40 so as to be movable in the vertical directions to be approachable/separable with respect to the tubular member 60, the valve element closing the through hole 60*a* in a state where the valve element butts against the tubular member 60; and a coil spring 62 (urging member) which urges the valve element 61 in a downward direction. The tubular member 60 and the valve element 61 are juxtaposed in the insertion direction of the ink supply pipe 15A.

The valve housing hole 40 is similar to that in the embodiment described above, and includes the small-diameter hole 41 formed in the tube 28, and the large-diameter hole 42 which communicates with the lower end of the small-diameter hole 41, and which is formed in the tube 31. The lower end of the valve housing hole 40 is opened to the outside through the insertion hole 43 formed in the cover member 21, thereby enabling the ink supply pipe 15A to be passed into the valve housing hole 40 from the lower side.

The tubular member 60 is fittingly attached into the large-diameter hole 42 so as to be vertically slidable between an atmospheric air closing position (see FIG. 8) where the atmospheric air communicating hole 31*a* formed in the tube 31 is closed, and an atmospheric air opening position (see FIGS. 9 and 10) where the atmospheric air communicating hole 31*a* is opened. The through hole 60*a* into which the ink supply pipe 15A is to be inserted is formed in a middle portion of the upper half of the tubular member 60. A tapered face 60*c* which is used for enabling the ink supply pipe 15A to be smoothly inserted into the through hole 60*a*, and in which the diameter is larger as further downward advancing is formed in the lower end of the through hole 60*a* so as to be continuous to the through hole 60*a*. In a state where the ink supply pipe 15A is inserted into the through hole 60*a*, the tubular member 60 is in close contact with the outer periphery of the ink supply pipe 15A. A coil spring 63 is placed inside the lower half of the tubular member 60. An annular spring receiving member 64 which receives the coil spring 63 from the lower side is disposed so as to be vertically movable relative to the tubular member 60.

Two sealing portions 60*b* which annularly protrude in an outer radial direction to be in sliding contact with the inner wall of the large-diameter hole 42 are disposed integrally on outer peripheral portions of upper and lower end portions of the tubular member 60, respectively. The two sealing portions 60*b* are in contact with the inner wall of the large-diameter hole 42, in a state where the sealing portions are slightly downward inclined, so that the resistance acting between the tubular member 60 and the large-diameter hole 42 when the tubular member is downward moved is larger than that acting when the tubular member is upward moved. In a state where the tubular member 60 and the large-diameter hole 42 are closely contacted with each other without forming a gap and the tubular member 60 is in the atmospheric air closing position (see FIG. 8), atmospheric air is prevented by the sealing portions 60*b* from flowing from the outside into the atmospheric air introducing space 26 (see FIG. 1) through the atmospheric air communicating hole 31*a*.

The valve element 61 is configured in a substantially same manner as the valve element 45 (see FIGS. 2 to 6) of the first embodiment. Namely, the valve element 61 is attached to the small-diameter hole 41 so as to be vertically movable in a state where the valve element is guided by the guiding portions 47 formed on the inner side face of the small-diameter hole 41. The gaps between the guiding portions 47 constitute a part of the ink path 23A. A pressing face 61*a* and an annular sealing portion 61*b* which are upward pressed by a small-diameter portion 16A of the ink supply pipe 15A are formed on the lower end face of the valve element 61.

In the small-diameter hole 41, the coil spring 62 is placed above the valve element 61, so that the valve element 61 is downward urged by the coil spring 62. The elastic force of the coil spring 62 is weaker than that of the coil spring 63 placed in the tubular member 60.

As shown in FIGS. 8 to 10, the ink supply pipe 15A which protrudes from the attaching portion 4 of the inkjet printer has the small-diameter portion 16A which is on the side of the tip end, and a large-diameter portion 17A. An operating portion 65 through which the small-diameter portion 16A is continuously connected to the large-diameter portion 17A is formed integrally on an outer peripheral portion of the ink supply pipe 15A. A tip end portion of the small-diameter portion 16A is formed into a rounded shape. In the small-diameter portion 16A, a plurality of ink inflow ports 66 which allow the interior of the ink supply pipe 15A to communicate with the exterior are formed. The operating portion 65 is formed as an annular face which, when the ink supply pipe 15A is inserted into the through hole 60*a*, can butt against the annular spring receiving member 64.

Next, the opening and closing operations of the valve mechanism 22A which are conducted during the processes of attaching and detaching the ink cartridge 3A will be described.

As shown in FIG. 8, in a state where the ink supply pipe 15A has not yet been inserted into the cartridge body 20, the valve element 61 is downward urged by the urging force of the coil spring 62 to butt against the tubular member 60, so that the through hole 60*a* of the tubular member 60 is closed by the valve element 61. Moreover, also the tubular member 60 is downward urged via the valve element 61 by the urging force of the coil spring 62, and engagingly held by the cover member 21, so that the tubular member 60 is in the atmospheric air closing position where the atmospheric air communicating hole 31*a* is closed.

When the ink cartridge 3A is attached to the inkjet printer, the ink supply pipe 15A is inserted into the cartridge body 20 through the insertion hole 43. As shown in FIG. 9, then, the small-diameter portion 16A of the ink supply pipe 15A is inserted into the through hole 60*a*, and the operating portion 65 having the annular face butts against the lower face of the annular spring receiving member 64. The distance between the operating portion 65 of the ink supply pipe 15A and the upper end of the small-diameter portion 16A is set to be shorter than that between the lower face of the spring receiving member 64 and the tubular member 60. Therefore, the upper end of the ink supply pipe 15A has not yet butted against the valve element 61. The resistance acting between the sealing portions 60*b* and the large-diameter hole 42 when the tubular member 60 is upward moved is smaller than that acting when the tubular member is downward moved, so that the tubular member 60 can be upward moved in a relatively smooth manner. Moreover, the elastic force of the coil spring 63 which is received by the spring receiving member 64 is stronger than that of the coil spring 62 which downward urges the valve element 61. When the insertion of the ink supply pipe 15A is further advanced, therefore, the operating portion 65 pushes up the tubular member 60 via the spring receiving member 64 and the coil spring 63, and, in conjunction with the operation of inserting the ink supply pipe 15A, the tubular member 60 and the valve element 61 are integrally upward pushed up against the urging force of the coil spring 62 until the upper face of the tubular member 60 butts against the upper wall of the large-diameter hole 42, i.e., the partition wall 27. As a result, the tubular member 60 is moved from the atmospheric air closing position of FIG. 8 to the atmospheric air opening position of FIG. 9, and hence the atmospheric air communicating hole 31*a* communicates with the large-diameter hole 42. As indicated by the broken arrow in FIG. 9, therefore, the atmospheric air path 24A which elongates from the insertion hole 43 to the atmospheric air communicating hole 31*a* and the atmospheric air introducing space 26 is opened, and atmospheric air is introduced into the ink storing space 25.

When the ink supply pipe 15A is further inserted into the valve housing hole 40 in a state where, as shown in FIG. 9, the tubular member 60 butts against the upper wall of the large-diameter hole 42 and is in the atmospheric air opening position, the ink supply pipe 15A is upward moved while the operating portion of the ink supply pipe 15A compresses the coil spring 63 as shown in FIG. 10, the tip end of the small-diameter portion 16A butts against the pressing face 61*a* of the valve element 61 to push up the valve element 61, and the valve element 61 is separated from the tubular member 60. As indicated by the arrows in FIG. 10, therefore, the ink path 23A which elongates from the ink introducing hole 28*a* to the portion below the pressing face 61*a* via the small-diameter hole 41, and the gaps between the valve element and the small-diameter hole 41 is opened. At this time, the ink inflow ports 66 of the small-diameter portion 16A which upward protrudes from the through hole 60*a* communicate with the interior of the large-diameter hole 42. Since the ink path 23A communicates with the ink supply pipe 15A in a state where the through hole 60*a* is in close contact with the outer periphery of the ink supply pipe 15A, the ink is prevented from downward flowing out along the outer face of the ink supply pipe 15A when the ink is supplied to the ink supply pipe 15A.

After being produced, the ink cartridge 3A is vacuum packed in a sealed bag, and also the interior of the cartridge body 20 is depressurized. In the case where the ink cartridge 3A is attached to the inkjet printer, when the ink path 23A is opened by the valve element 61 before the atmospheric air path 24A is opened by the tubular member 60, therefore, the ink in the ink supply pipe 15A reversely flows into the cartridge body 20 in a decompressed state. Then, atmospheric air penetrates through nozzles of the inkjet head 2 connected to the ink supply pipe 15A, thereby causing the possibility that the ink cannot be correctly ejected from the inkjet head 2. In Modification A, by contrast, when the ink supply pipe 15A is inserted into the cartridge body 20, the tubular member 60 is upward moved in conjunction with the inserting operation to open the atmospheric air path 24A, and also the valve element 61 is then upward moved to open the ink path 23A. Therefore, the ink does not reversely flow from the ink supply pipe 15A into the ink cartridge 3A.

By contrast, in the case where the ink cartridge 3A is detached from the inkjet printer, when the ink supply pipe 15A is extracted from the cartridge body 20, the valve element 61 is downward urged by the urging force of the coil spring 62 to butt against the tubular member 60, and the ink path 23A is closed. The valve element 61 and the tubular member 60 are integrally downward moved by the urging force of the coil spring 62, and the atmospheric air path 24A is closed.

In the ink cartridge 3A, when the ink supply pipe 15A is attached to the cartridge body, the second opening-closing portion 60 opens the atmospheric air path, and the first opening-closing portion 61 then opens the ink path. After production, an ink cartridge is vacuum packed in a sealed bag, and also the interior of the cartridge body is depressurized. In the case where the ink cartridge is attached to the ink-jet printer, when the ink path is opened by the first opening-closing portion before the atmospheric air path is opened by the second opening-closing portion, therefore, the ink in the ink supply pipe reversely flows into the cartridge body in a decompressed state. Then, atmospheric air penetrates through nozzles of an inkjet head connected to the ink supply pipe, thereby causing the possibility that the ink cannot be correctly ejected from the inkjet head. By contrast, the ink cartridge of the eighth invention is configured so that the second opening-closing portion opens the atmospheric air path, and the first opening-closing portion then opens the ink path. Therefore, the ink does not reversely flow into the ink cartridge, and the ink can be correctly ejected from the inkjet head.

In the ink cartridge 3A, the first and second opening-closing portions 61, 60 are configured by separate components, respectively, and, in conjunction with the operation of attaching the ink supply pipe 15A, the first and second opening-closing portions are integrally moved to open the atmospheric air path, and the first opening-closing portion is then separated from the second opening-closing portion to open the ink path. When the ink supply pipe is attached to the cartridge body, therefore, the second opening-closing portion opens the atmospheric air path, and the first opening-closing portion is then separated from the second opening-closing portion to open the ink path. As a result, the ink does not reversely flow from the ink supply pipe into the ink cartridge.

(Modification B)

Figure 11:
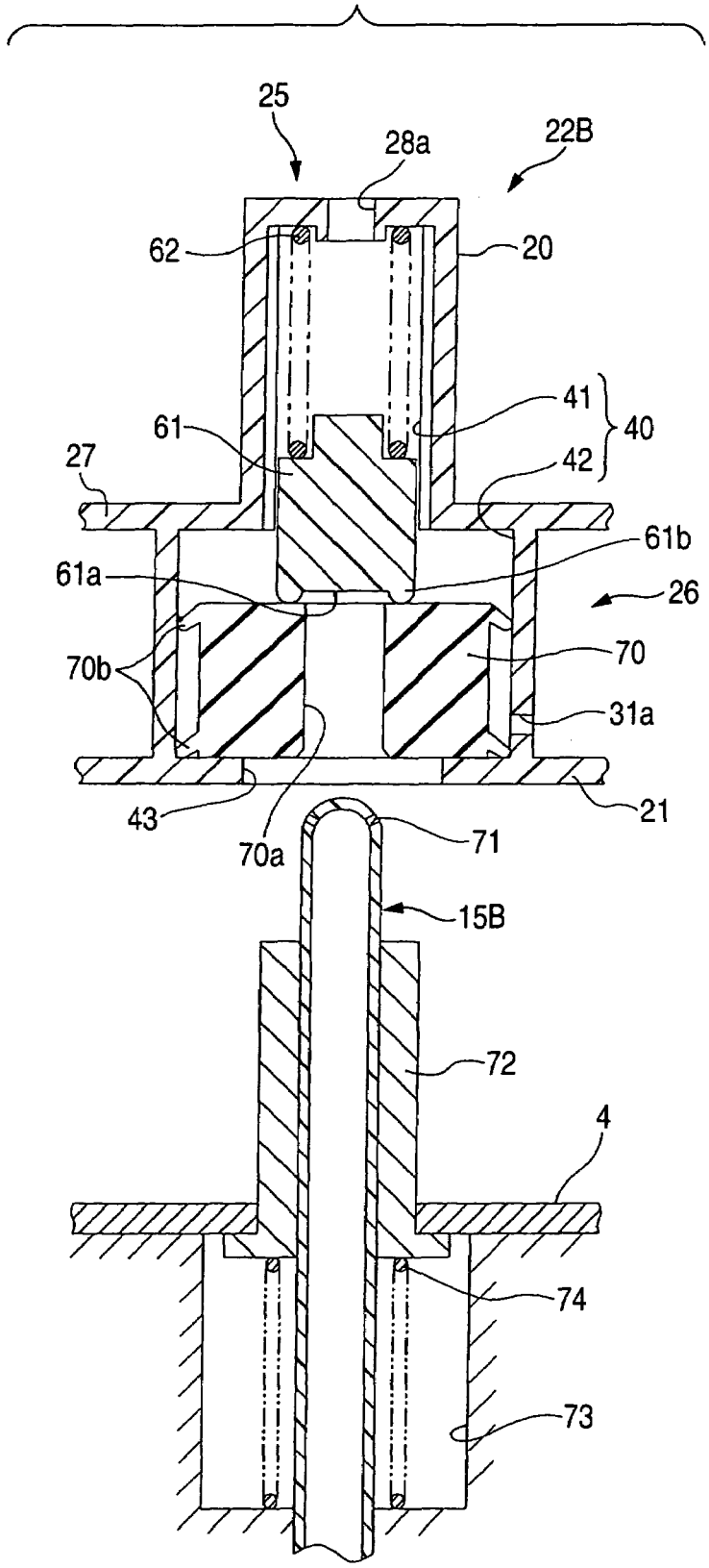
FIG. 11 is an enlarged view of a valve mechanism before an ink cartridge of Modification B is attached.
Figure 12:
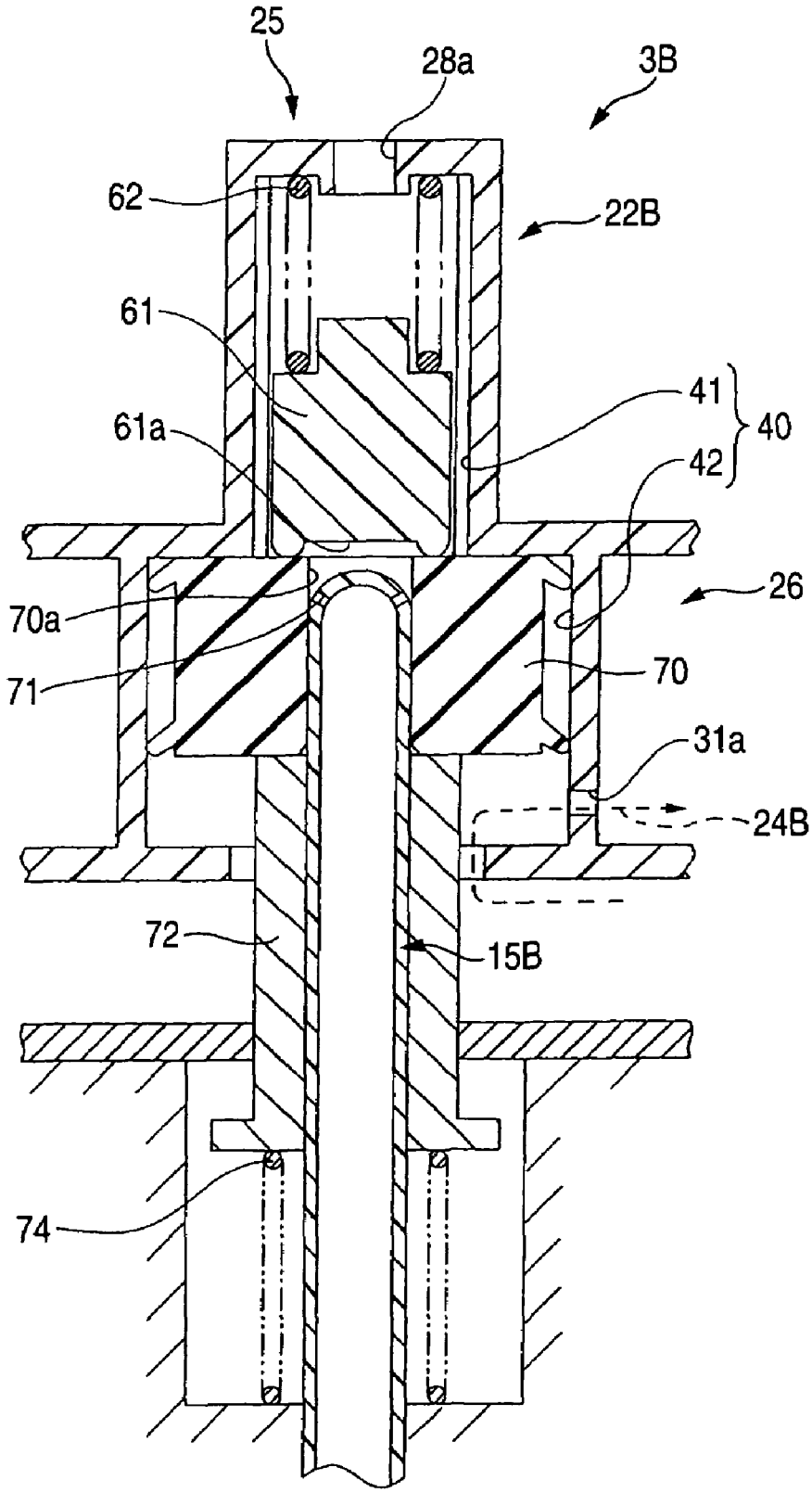
FIG. 12 is an enlarged view of the valve mechanism during an operation of attaching the ink cartridge.
Figure 13:
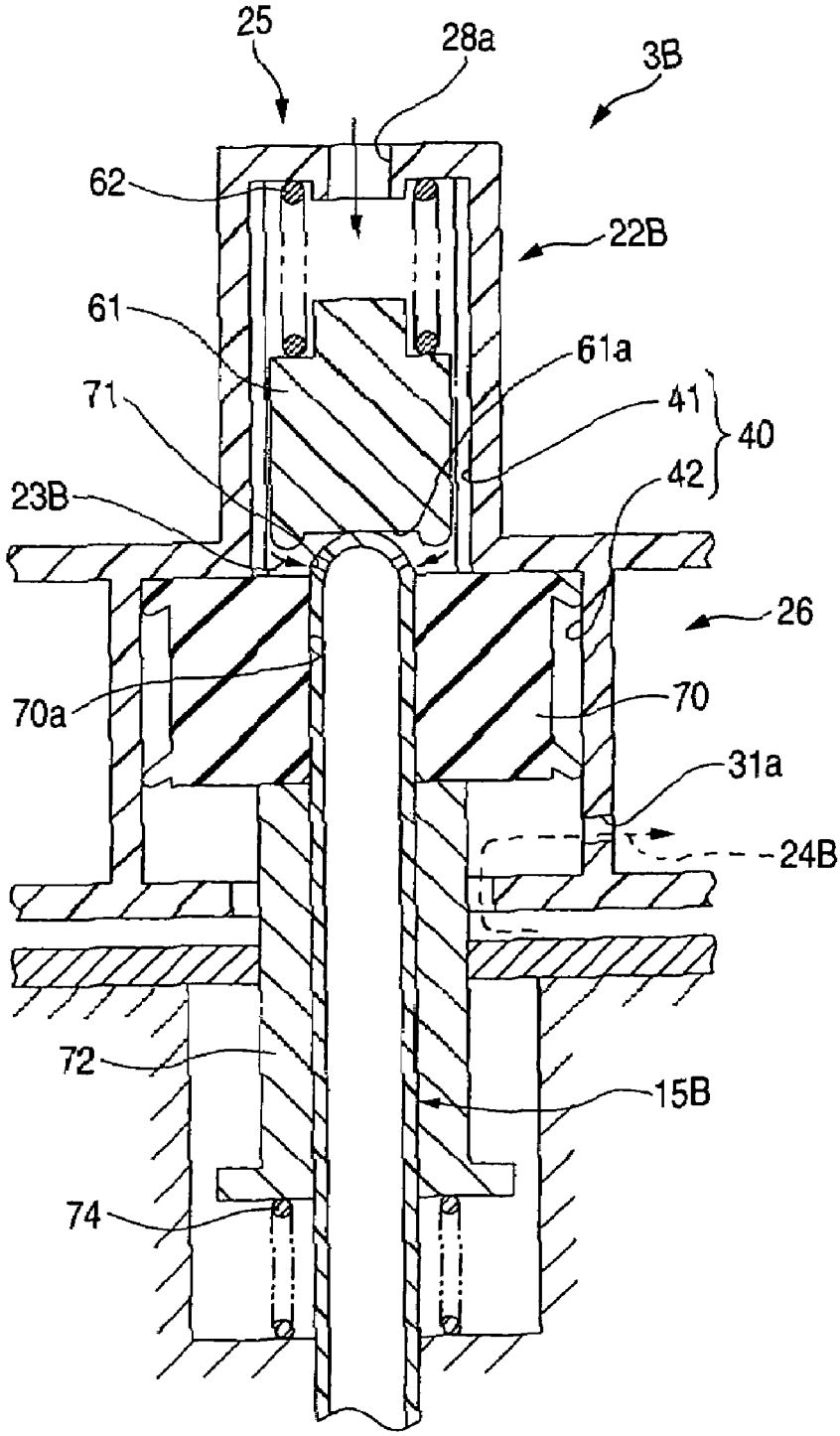
FIG. 13 is an enlarged view of the valve mechanism in a state where the operation of attaching the ink cartridge is completed.

Modification B is different from Modification A in the shape of the tubular member. As shown in FIGS. 11 to 13, a tubular member 70 of a valve mechanism 22B is fittingly attached into the large-diameter hole 42 so as to be vertically slidable. A through hole 70*a* in to which an ink supply pipe 15B is to be inserted is formed in the tubular member 70. In a state where the ink supply pipe 15B is inserted into the through hole 70*a*, the tubular member 70 is in close contact with the outer periphery of the ink supply pipe 15B. In the same manner as Modification A, two sealing portions 70*b* are disposed on an outer peripheral portion of the tubular member 70.

As shown in FIGS. 11 to 13, a tip end portion of the ink supply pipe 15B which is protrudingly disposed in the attaching portion 4 of the inkjet printer is formed into a rounded shape. In the tip end portion, a plurality of ink inflow ports 71 which allow the interior of the ink supply pipe 15B to communicate with the exterior are formed. A tubular operating portion 72 is fitted onto the ink supply pipe 15B so as to be vertically movable relative to the ink supply pipe 15B. The tubular operating portion 72 is upward urged by a coil spring 74 which is housed in a spring housing chamber 73 in a bottom portion of the attaching portion 4. The elastic force of the coil spring 74 is stronger than that of the coil spring 62 which downward urges the valve element 61. In a state where the operating portion 72 is pushed up by the coil spring 74 before an ink cartridge 3B is attached to the attaching portion 4, the distance between the upper end of the operating portion 72 and the end of the ink supply pipe 15B is set to be shorter than that between the lower and upper faces of the tubular member 70. In this state, the upper end of the ink supply pipe 15B is not required to protrude from the upper end of the operating portion 72.

Next, operations of the valve mechanism 22B which are conducted during the processes of attaching and detaching the ink cartridge 3B will be described.

As shown in FIG. 11, in a state where the ink supply pipe 15B has not yet been inserted into the cartridge body 20, the valve element 61 is downward urged by the urging force of the coil spring 62 to butt against the tubular member 70, so that the through hole 70*a* of the tubular member 70 is closed by the valve element 61. Moreover, also the tubular member 70 is downward urged via the valve element 61 by the urging force of the coil spring 72, and engagingly held by the cover member 21, so that the tubular member 70 is in the atmospheric air closing position where the atmospheric air communicating hole 31*a* is closed.

As shown in FIG. 12, when the ink supply pipe 15B is inserted into the cartridge body 20, the upper end of the operating portion 72 butts against the lower face of the tubular member 70, but the upper end of the ink supply pipe 15B has not yet butted against the valve element 61. Since the elastic force of the coil spring 74 which upward urges the operating portion 72 is stronger than that of the coil spring 62 which downward urges the valve element 61, the tubular member 70 and the valve element 61 are pushed up by the operating portion 72 against the urging force of the coil spring 62 until the upper face of the tubular member 70 butts against the upper wall of the large-diameter hole 42. As a result, the tubular member 70 is moved from the atmospheric air closing position of FIG. 11 to the atmospheric air opening position of FIG. 12, and hence the atmospheric air communicating hole 31*a* communicates with the large-diameter hole 42. As indicated by the broken arrow in FIG. 12, therefore, an atmospheric air path 24B which elongates from the insertion hole 43 to the atmospheric air communicating hole 31*a* and the atmospheric air introducing space 26 is opened, and atmospheric air is introduced into the ink storing space 25.

When the ink supply pipe 15B is further inserted into the valve housing hole 40 in a state where, as shown in FIG. 12, the tubular member 70 is moved to the atmospheric air opening position and the upper face of the tubular member 70 butts against the upper wall of the large-diameter hole 42, the movements of the operating portion 72 and the tubular member 70 are restricted, and hence only the ink supply pipe 15B is further inserted into the valve housing hole 40 against the urging forces of the coil springs 62, 74 as shown in FIG. 13. The tip end of the ink supply pipe 15B butts against the pressing face 61*a* of the valve element 61 to push up the valve element 61, and the valve element 61 is separated from the tubular member 70. As indicated by the arrow in FIG. 13, therefore, the ink path 23B which elongates from the ink introducing hole 28*a* to the portion below the pressing face 61*a* via the small-diameter hole 41, the gaps between the valve element 61 and the small-diameter hole 41, and the small-diameter hole 41 is opened. At this time, the ink inflow ports 71 of the tip end portion of the ink supply pipe 15B which upward protrudes from the through hole 70*a* communicate with the interior of the small-diameter hole 41.

The operation of the valve mechanism 22B which is conducted during the process of detaching the ink cartridge 3B is substantially identical with that in Modification A. Specifically, the valve element 61 first butts against the tubular member 70 to close the ink path 23B. Then, the valve element 61 and the tubular member 70 are integrally downward moved to close the atmospheric air path 24B.

In this inkjet printer, the operating portion 72 is disposed to be movable relative to the ink supply pipe 15B in parallel to an attachment direction of the ink supply pipe, and, after, in conjunction with the operation of attaching the ink supply pipe, the operating portion butts against the second opening-closing portion to move the second opening-closing portion to the position where the atmospheric air path is opened, the ink supply pipe 15B moves the first opening-closing portion to a position where the ink path is opened. When the ink supply pipe is attached to the cartridge body, therefore, the second opening-closing portion is moved to open the atmospheric air path, by the operating portion which is relatively movable with respect to the ink supply pipe, and the first opening-closing portion is then moved by the ink supply pipe, so that the ink path can be opened.

(Modification C)

Modification C is different from Modifications A, B in the shape of the tubular member. A tubular member 80 of a valve mechanism 22C is fittingly attached into the large-diameter hole 42 so as to be vertically slidable. A through hole 80*a* into which an ink supply pipe 15C is to be inserted is formed in the tubular member 80. A tapered hole portion 80*c* in which the diameter is smaller as further upward advancing is formed in an upper end portion of the through hole 80*a*. When the ink supply pipe 15C is inserted into the through hole 80*a*, the tapered hole portion 80*c* is in close contact with the outer periphery of the ink supply pipe 15C. The taper angle of the tapered hole portion 80*c* is set so that the resistance (friction force) acting between the ink supply pipe 15C and the tapered hole portion 80*c* is larger than the elastic force of the coil spring 62 which downward urges the valve element 61. In the same manner as Modification A, two sealing portions 80*b* are disposed on an outer peripheral portion of the tubular member 80.

Figure 14:
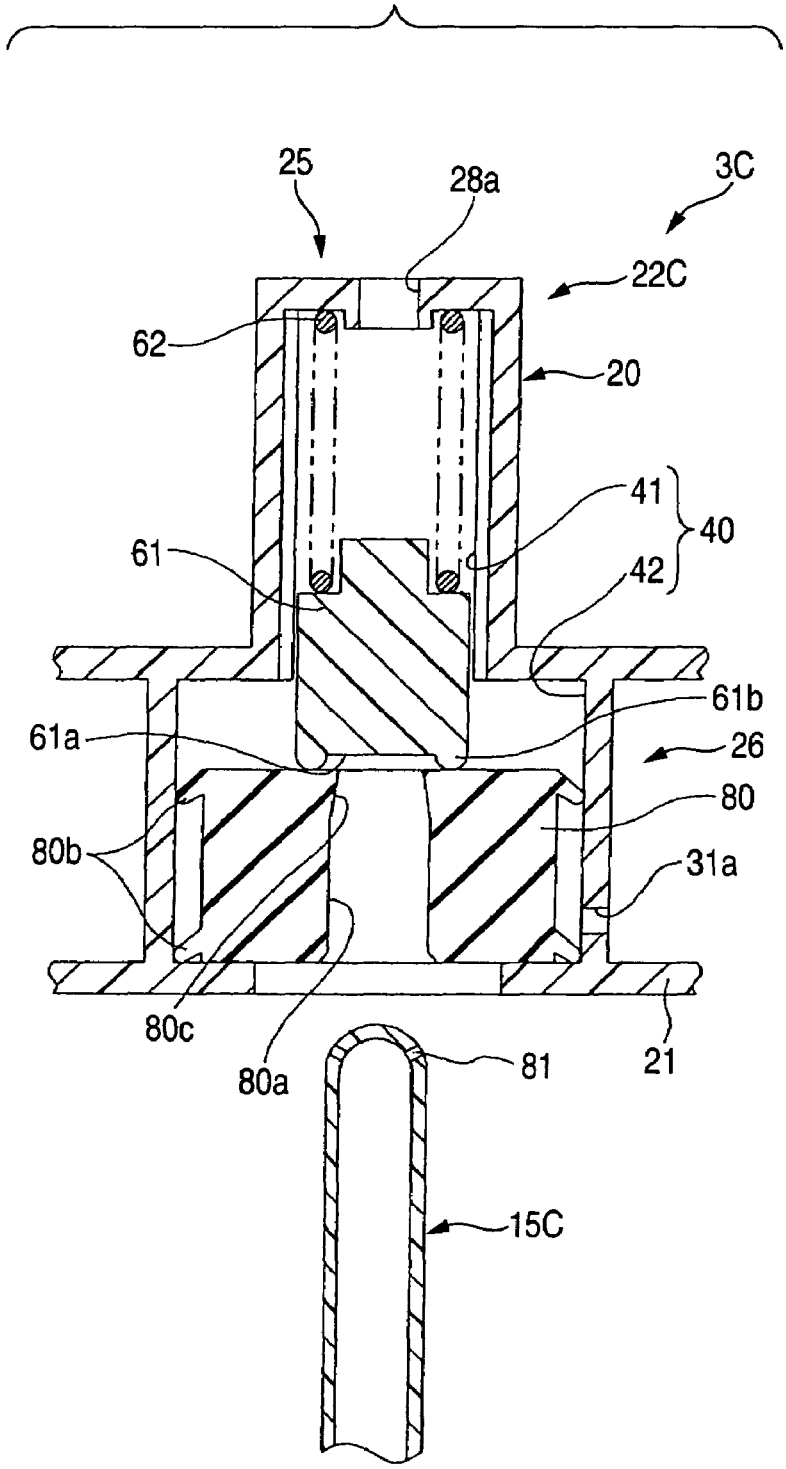
FIG. 14 is an enlarged view of a valve mechanism before an ink cartridge of Modification C is attached.
Figure 15:
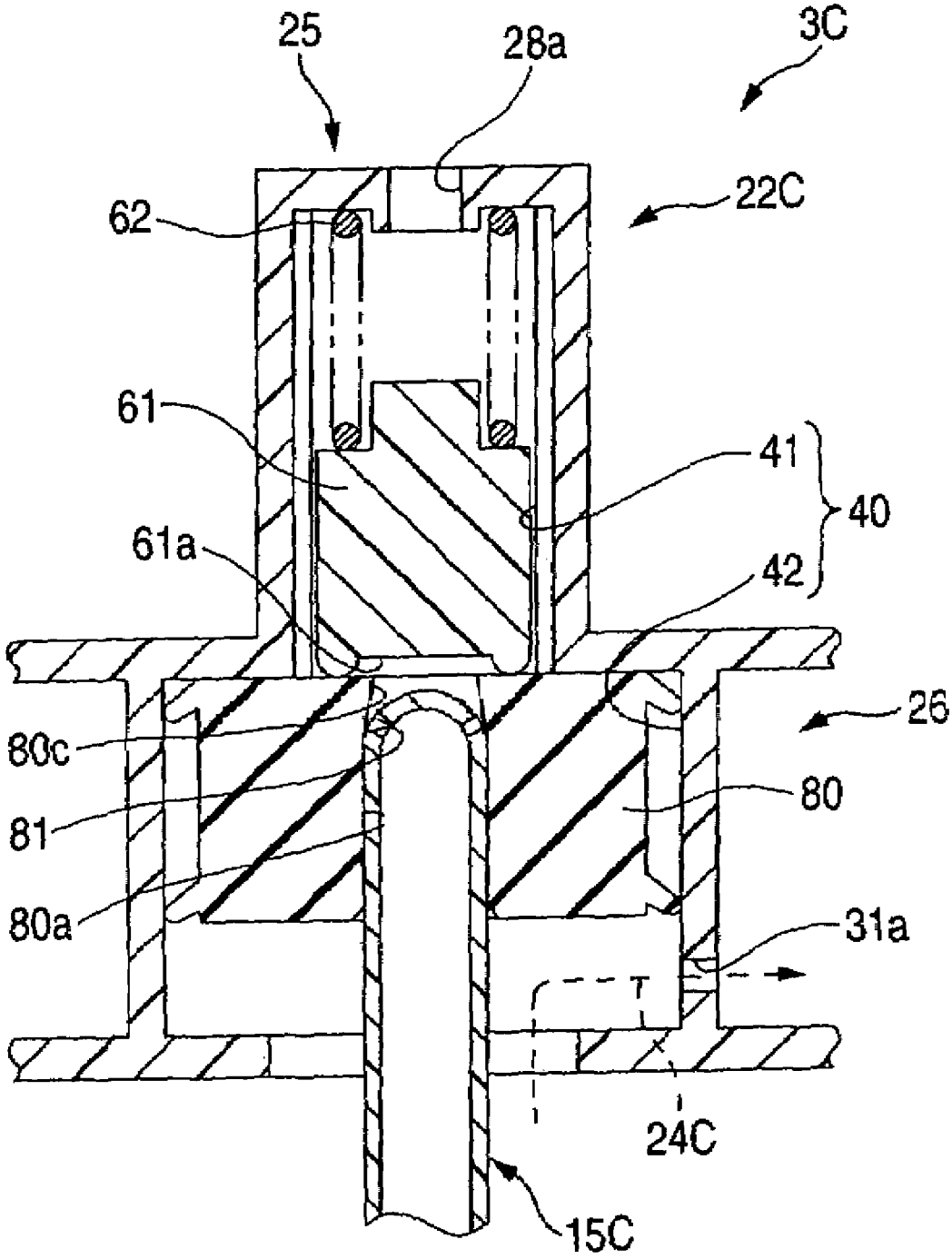
FIG. 15 is an enlarged view of the valve mechanism during an operation of attaching the ink cartridge.
Figure 16:
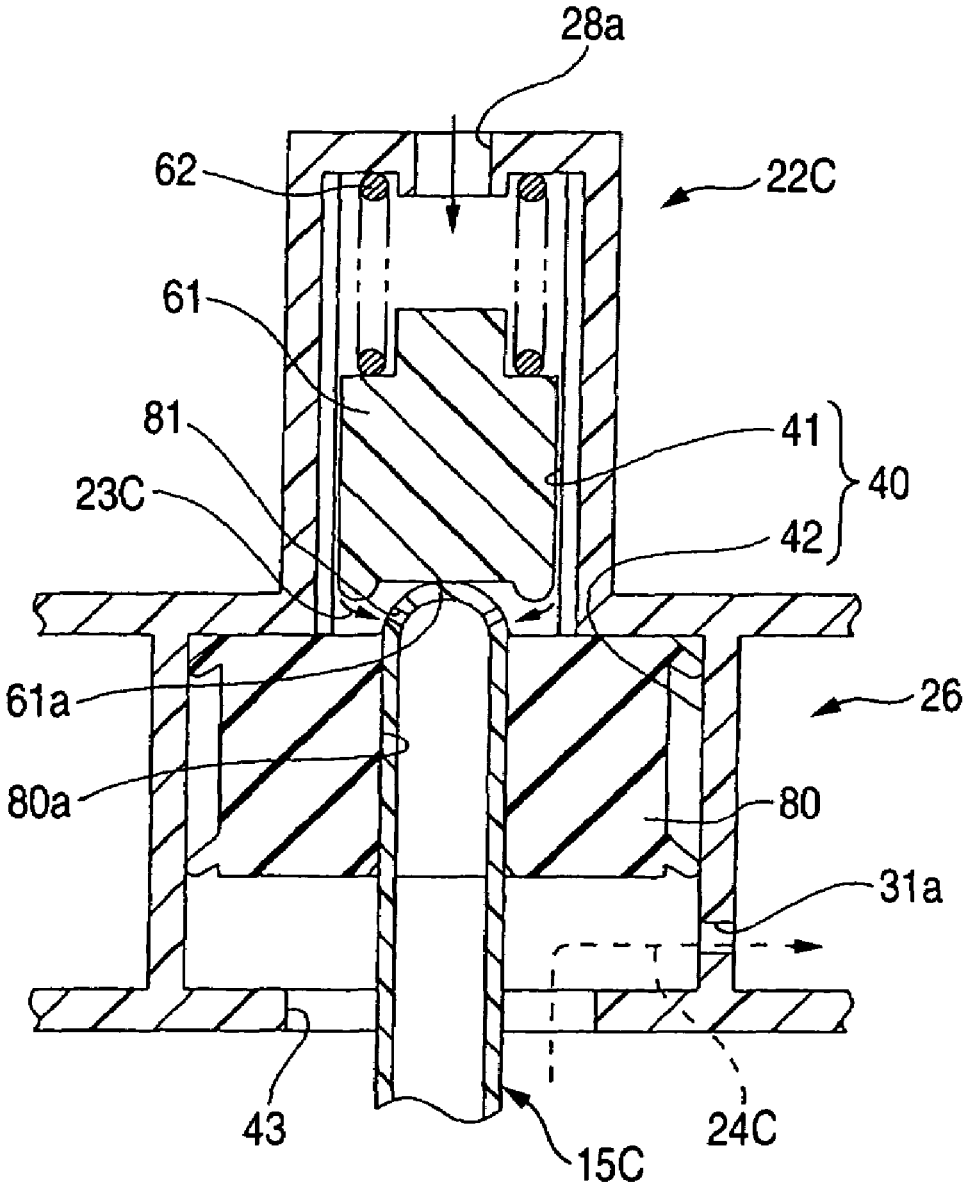
FIG. 16 is an enlarged view of the valve mechanism in a state where the operation of attaching the ink cartridge is completed.

As shown in FIGS. 14 to 16, a tip end portion of the ink supply pipe 15C which is disposed in the attaching portion 4 of the inkjet printer is formed into a rounded shape. In the tip end portion, a plurality of ink inflow ports 81 which allow the interior of the ink supply pipe 15C to communicate with the exterior are formed.

The outer peripheral portion of the ink supply pipe 15C which pushes up the tubular member 80 by means of friction acting between the portion and the tapered hole portion 80*c* as described later functions also as an operating portion for the tubular member 80.

Next, operations of the valve mechanism 22C which are conducted during the processes of attaching and detaching the ink cartridge 3C will be described. As shown in FIG. 14, in a state where the ink supply pipe 15C has not yet been inserted into the cartridge body 20, the valve element 61 is downward urged by the urging force of the coil spring 62 to butt against the tubular member 80, so that the through hole 80*a* of the tubular member 80 is closed by the valve element 61.

Also the tubular member 80 is downward urged via the valve element 61 by the urging force of the coil spring 62 and engagingly held by the cover member 21, so that the tubular member 80 is in the atmospheric air closing position where the atmospheric air communicating hole 31*a* is closed.

As shown in FIG. 15, when the ink supply pipe 15C is inserted into the cartridge body 20, the tip end portion of the ink supply pipe 15C is inserted into the through hole 80*a* of the tubular member 80, and then in contact with the tapered hole portion 80*c*. Since the resistance (friction force) acting between the ink supply pipe 15C and the tapered hole portion 80*c* is larger than the elastic force of the coil spring 62 which downward urges the valve element 61, the tubular member 80 and the valve element 61 are pushed up against the urging force of the coil spring 62 until the tubular member 80 butts against the upper wall of the large-diameter hole 42. As a result, the tubular member 80 is moved from the atmospheric air closing position of FIG. 14 to the atmospheric air opening position of FIG. 15, and hence the atmospheric air communicating hole 31*a* communicates with the large-diameter hole 42. As indicated by the broken arrow in FIG. 15, therefore, an atmospheric air path 24C which elongates from the insertion hole 43 to the atmospheric air communicating hole 31*a* and the atmospheric air introducing space 26 is opened, and atmospheric air is introduced into the ink storing space 25. At this time, a friction resistance of a certain degree is set between the tapered hole portion 80*c* and the ink supply pipe 15C so that the tip end portion of the ink supply pipe 15C may be upward exposed from the upper face of the tubular member 80 through the through 80*a*, but the tip end portion does not butt against the pressing face 61*a* of the valve element 61.

When the ink supply pipe 15C is further inserted into the valve housing hole 40 in a state where, as shown in FIG. 15, the tubular member 80 is moved to the atmospheric air opening position to butt against the upper wall of the large-diameter hole 42, the tip end portion of the ink supply pipe 15C is upward protruded from the tubular member 80 against the resistance acting between the tip end portion and the tapered hole portion 80*c*. Then, the tip end portion of the ink supply pipe 15C butts against the pressing face 61*a* of the valve element 61 to push up the valve element 61, and the valve element 61 is separated from the tubular member 80. As indicated by the arrow in FIG. 16, therefore, the ink path 23C which elongates from the ink introducing hole 28*a* to the portion below the pressing face 61*a* via the small-diameter hole 41, the gaps between the valve element 61 and the small-diameter hole 41, the small-diameter hole 41 is opened. At this time, the ink inflow ports 81 formed in the tip end portion of the ink supply pipe 15C communicate with the interior of the small-diameter hole 41.

The operation of the valve mechanism 22C which is conducted during the process of detaching the ink cartridge 3C is substantially identical with the operations in Modifications A, B. Specifically, the valve element 61 first butts against the tubular member 80 to close the ink path 23C. Then, the valve element 61 and the tubular member 80 are integrally downward moved to close the atmospheric air path 24C.

(Modification D)

Figure 17:
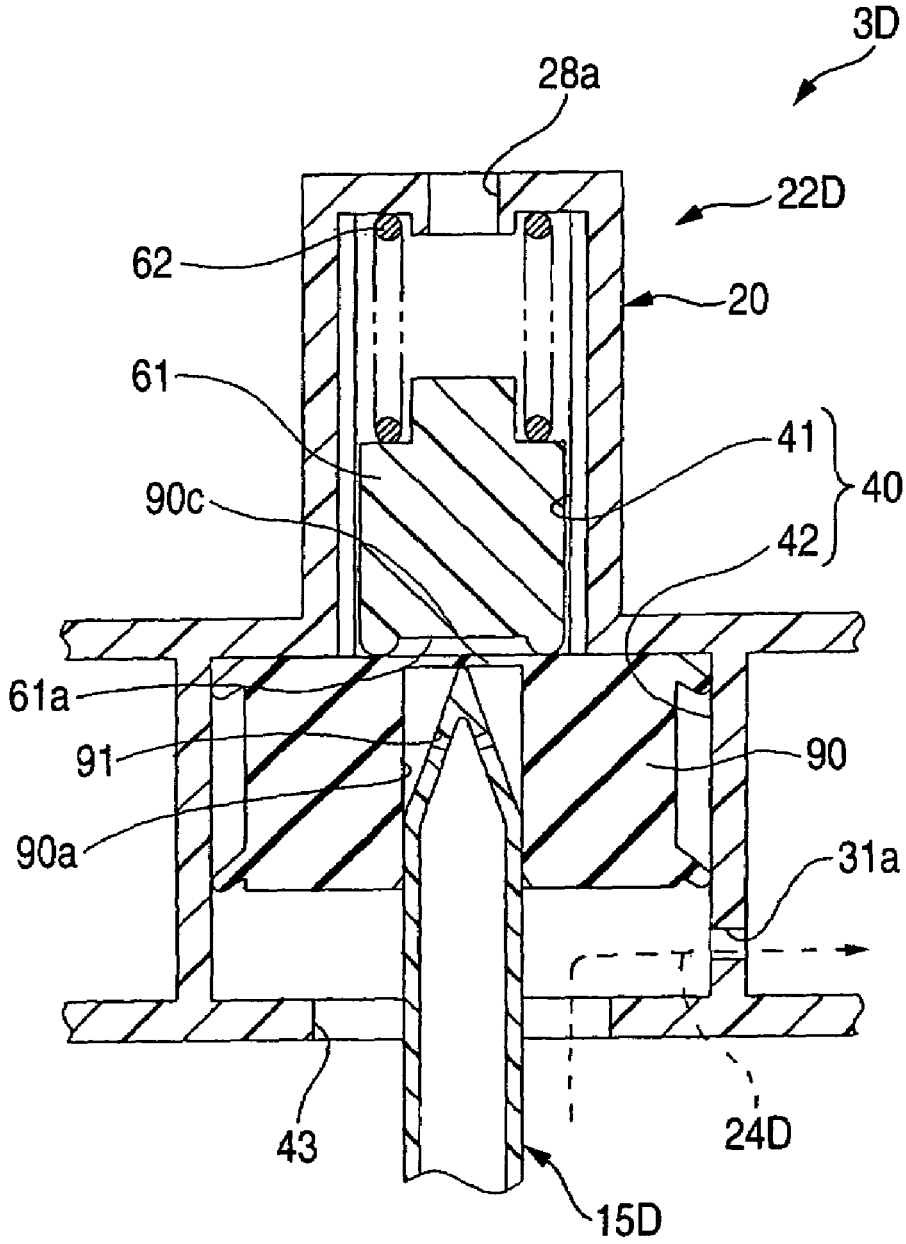
FIG. 17 is an enlarged view of a valve mechanism during an operation of attaching an ink cartridge Modification D.
Figure 18:
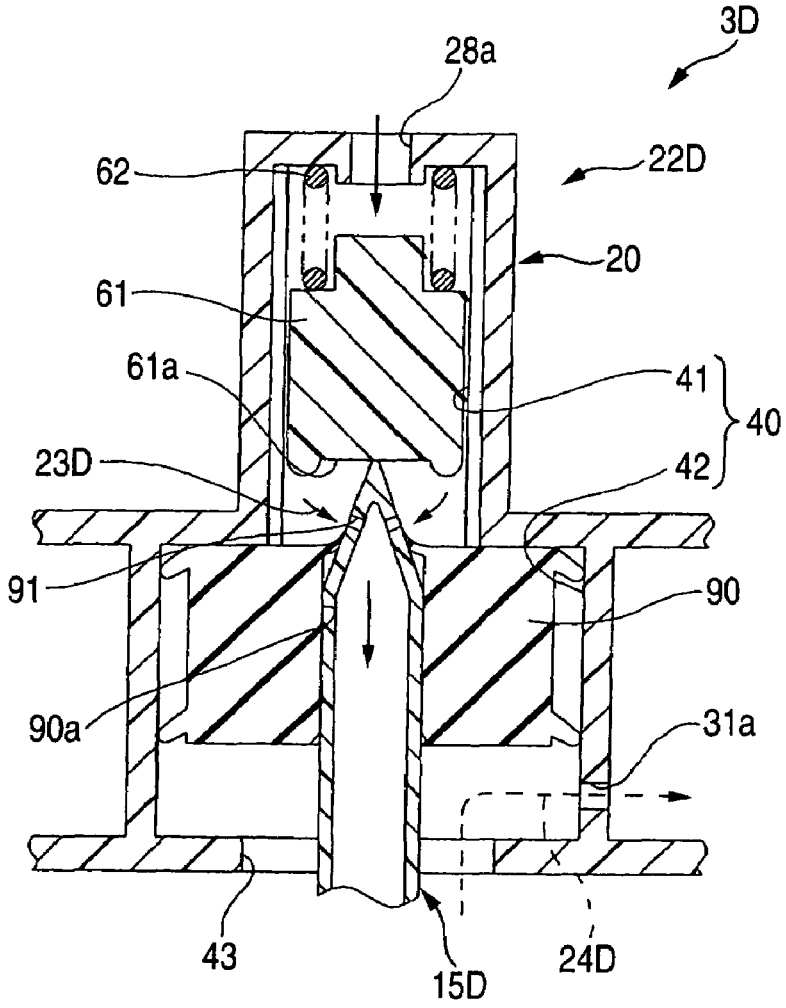
FIG. 18 is an enlarged view of the valve mechanism in a state where the operation of attaching the ink cartridge is completed.

Modification D is different from Modifications A to C in the shape of the tubular member. As shown in FIGS. 17 and 18, a tubular member 90 of a valve mechanism 22D is fittingly attached into the large-diameter hole 42 so as to be vertically slidable. A through hole 90*a* into which an ink supply pipe 15D is to be inserted is formed in the tubular member 90. In a state where the ink supply pipe 15D is inserted into the through hole 90*a*, the tubular member 90 is in close contact with the outer periphery of the ink supply pipe 15D. In the same manner as Modification A, two sealing portions 90*b* are disposed on an outer peripheral portion of the tubular member 90. In a state where the ink supply pipe 15D is not inserted into the through hole 90*a*, a sealing film 90*c* which closes the through hole 90*a* is formed in an upper end portion of the through hole 90*a*.

As shown in FIGS. 17 and 18, a tip end portion of the ink supply pipe 15D which is protrudingly disposed in the attaching portion 4 of the inkjet printer is formed into a pointed shape. In the tip end portion, a plurality of ink inflow ports 91 which allow the interior of the ink supply pipe 15D to communicate with the exterior are formed. The tip end portion of the ink supply pipe 15D which butts against the sealing film 90*c* in order to push up the tubular member 90 as described later, and the outer peripheral portion of the ink supply pipe 15D which generates a friction force between the portion and the through hole 90*a* function also as an operating portion for the tubular member 90.

Operations of the valve mechanism 22D which are conducted during the processes of attaching and detaching the ink cartridge 3D will be described.

In a state where the ink supply pipe 15D has not yet been inserted into the cartridge body 20, the valve element 61 is downward urged by the urging force of the coil spring 62 to butt against the tubular member 90. The throughhole 90*a* of the tubular member 90 is sealed by the sealing film 90*c* to attain a state where an ink path 23D is closed. Moreover, also the tubular member 90 is downward urged via the valve element 61 by the urging force of the coil spring 62, and engagingly held by the cover member 21, so that the tubular member 90 is in the atmospheric air closing position where the atmospheric air communicating hole 31*a* is closed.

As shown in FIG. 17, when the ink supply pipe 15D is inserted into the cartridge body 20, the tip end portion of the ink supply pipe 15D is inserted into the through hole 90*a* of the tubular member 90. At this time, the tip end portion of the ink supply pipe 15D butts against the sealing film 90*c*. The sum of the resistance (friction force) acting between the tubular member 90 and the ink supply pipe 15D, and the force at which the sealing film 90*c* is smashed by the ink supply pipe 15D is larger than the urging force of the coil spring 62 which downward urges the valve element 61. Therefore, the tubular member 90 and the valve element 61 are pushed up against the urging force of the coil spring 62 until the tubular member 90 butts against the upper wall of the large-diameter hole 42. As a result, the tubular member 90 is moved to the atmospheric air opening position of FIG. 17, and hence the atmospheric air communicating hole 31*a* communicates with the large-diameter hole 42. As indicated by the broken arrow in FIG. 18, therefore, an atmospheric air path 24D which elongates from the insertion hole 43 to the atmospheric air communicating hole 31*a* and the atmospheric air introducing space 26 is opened, and atmospheric air is introduced into the ink storing space 25.

When the ink supply pipe 15D is further inserted into the valve housing hole 40 in a state where, as described above, the tubular member 90 is moved to the atmospheric air opening position, the tip end portion of the ink supply pipe 15D having a pointed shape smashes the sealing film 90*c*, and is then upward protruded from the tubular member 90. Then, the tip end portion of the ink supply pipe 15D butts against the pressing face 61*a* of the valve element 61 to push up the valve element 61, and the valve element 61 is separated from the tubular member 90. As indicated by the arrows in FIG. 18, therefore, the ink path 23D which elongates from the ink introducing hole 28*a* to the portion below the pressing face 61*a* via the small-diameter hole 41, the gaps between the valve element 61 and the small-diameter hole 41, and the small-diameter hole 41 is opened. At this time, the ink inflow ports 91 formed in the tip end portion of the ink supply pipe 15D communicate with the interior of the small-diameter hole 41.

The operation of the valve mechanism 22D which is conducted during the process of detaching the ink cartridge 3D is substantially identical with the operations in Modifications A to C. Specifically, the valve element 61 first butts against the tubular member 90 to close the ink path 23D. Then, the valve element 61 and the tubular member 90 are integrally downward moved to close the atmospheric air path 24D.

Next, a second embodiment of the invention will be described.

Figure 19:
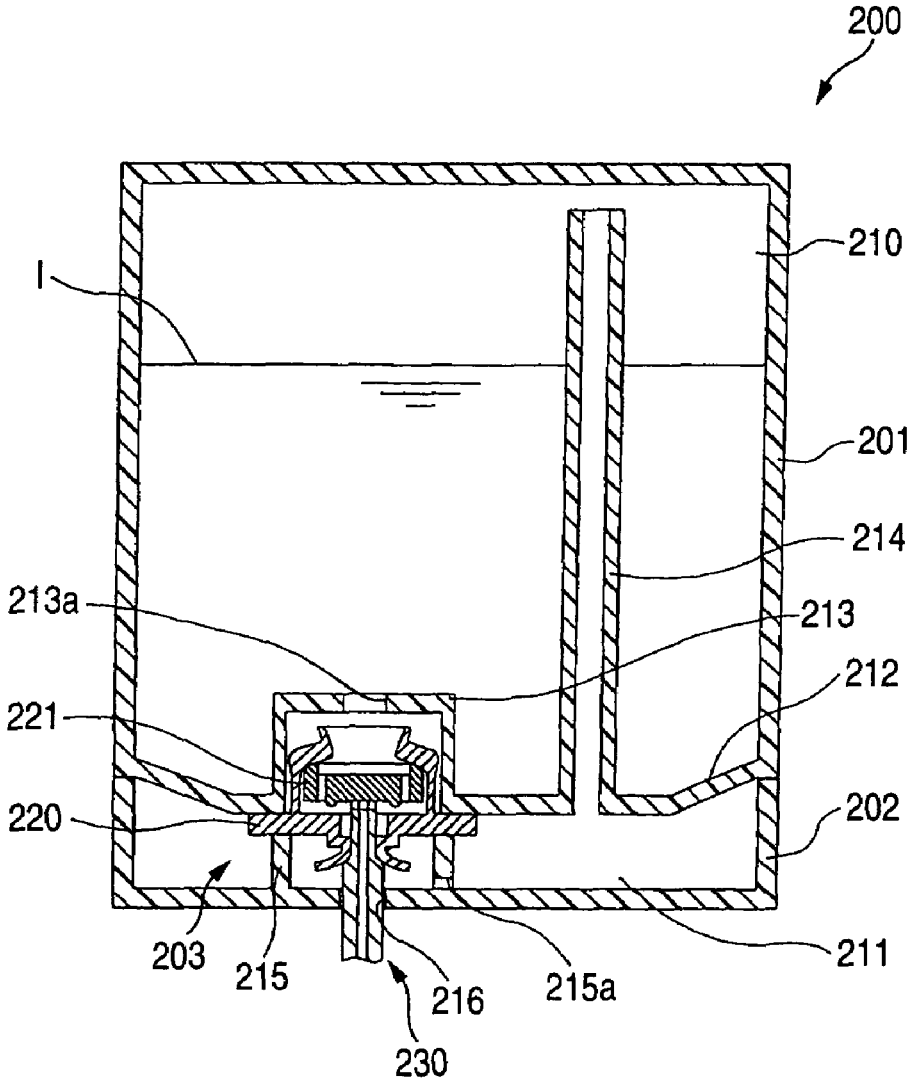
FIG. 19 is a longitudinal sectional view of an ink cartridge of a second embodiment.

As shown in FIG. 19, in the same manner as the first embodiment, an ink cartridge 200 of the second embodiment has a cartridge body 201 having an ink storing space 210 which stores the ink I; a cover member 202 which covers the lower end of the cartridge body 201; and a valve mechanism 203 that can open and close both an ink path 240 (the solid arrows in FIG. 22) through which the ink is supplied to the inkjet head 2, and an atmospheric air path 241 (the broken arrow in FIGS. 21 and 22) through which atmospheric air is introduced into the ink storing space 210. In the same manner as the embodiment described above, an ink supply pipe 230 is protrudingly disposed in the attaching portion 4.

In the cartridge body 201, a partition wall 212 is formed to vertically separate the ink storing space 210 which is substantially hermetically sealed to store the ink I, from an atmospheric air introducing space 211 into which atmospheric air is introduced from the outside. Two tubes 213, 214 which elongate toward the ink storing space 210, and which have different lengths are formed integrally with the partition wall 212. The upper half 217*a* of a valve housing hole 217 which will be described later is formed in the shorter tube 213, and an ink introducing hole 213*a* through which the ink I in the ink storing space 210 is introduced into the valve housing hole 217 is formed in an upper wall portion of the tube 213.

By contrast, the longer tube 214 elongates to the vicinity of a top plate of the cartridge body 201, and guides the atmospheric air in the atmospheric air introducing space 211 to an upper portion of the ink storing space 210.

The cover member 202 is fixed to a lower end portion of the cartridge body 201 by welding or the like. The atmospheric air introducing space 211 is defined by the cover member 202 and the partition wall 212. In the cover member 202, a tube 215 which elongates toward the atmospheric air introducing space 211 is formed at a position corresponding to the tube 213. The tube 215 forms the lower half 217*b* of the valve housing hole 217. An atmospheric air communicating hole 215*a* through which the valve housing hole 217 (217*b*) communicates with the atmospheric air introducing space 211 is formed in a side portion of the tube 215. An insertion hole 216 which communicates with the lower half 217*b* of the valve housing hole 217 is formed in the cover member 202.

The valve mechanism 203 has: the valve housing hole 217 (217*a*, 217*b*) which constitutes parts of the ink path 240 and the atmospheric air path 241; an elastic valve member 220 which is made of synthetic rubber or the like; and a valve element 221 (first opening-closing portion) which is made of a synthetic resin or the like, and which is housed in the valve member 220. The valve member 220 has: a valve seat portion 222 having a through hole 222*a* into which the ink supply pipe 230 is to be inserted; an urging portion 223 (urging member) which is placed above the valve seat portion 222; and an atmospheric air path opening-closing portion 224 (second opening-closing portion) which is placed below the valve seat portion 222. The valve seat portion 222, the urging portion 223, and the atmospheric air path opening-closing portion 224 (second opening-closing portion) are integrally configured.

An outer peripheral portion of the valve member 220 is clamped between the partition wall 212 and the tube 215, whereby the valve member is fixed.

The valve seat portion 222 is formed into a substantially horizontal plate-like shape. The through hole 222*a* into which the ink supply pipe 230 is to be inserted is formed in a middle portion of the valve seat portion 222. The urging portion 223 has: a cylindrical side wall portion 223*a* which rises from an outer peripheral side portion of the valve seat portion 222; and a projected portion 223*b* which is radially inward projected integrally from the upper end of the side wall portion 223*a*. The lower face of the projected portion 223*b* butts against the valve element 221 housed inside the urging portion 223, and the valve element 221 is downward urged by the elastic forces of the side wall portion 223*a* and the projected portion 223*b*. An opening 223*c* constituting a part of the ink path 240 is formed inside the projected portion 223*b*.

Figure 20:
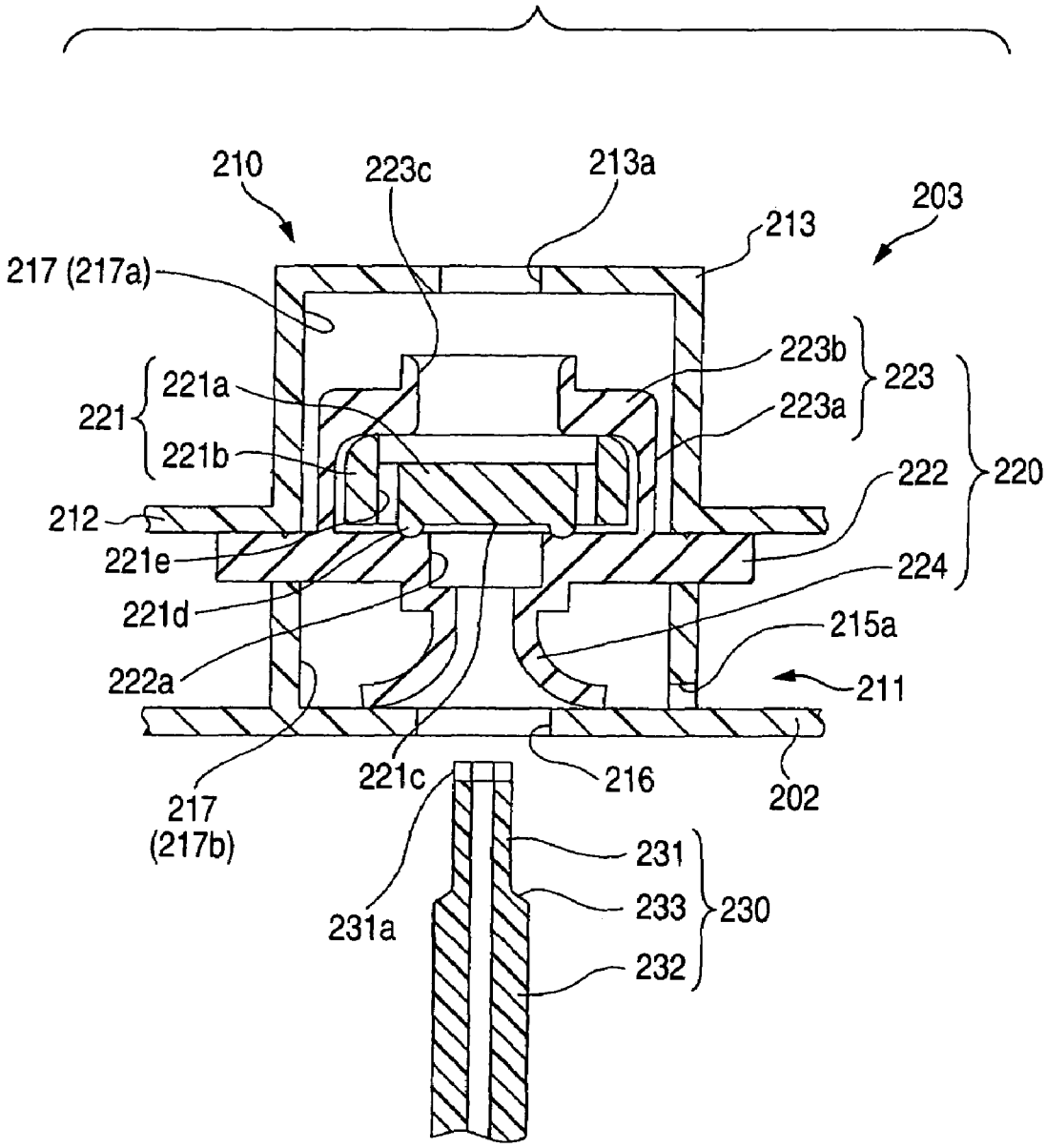
FIG. 20 is an enlarged view of a valve mechanism before the ink cartridge is attached.
Figure 21:
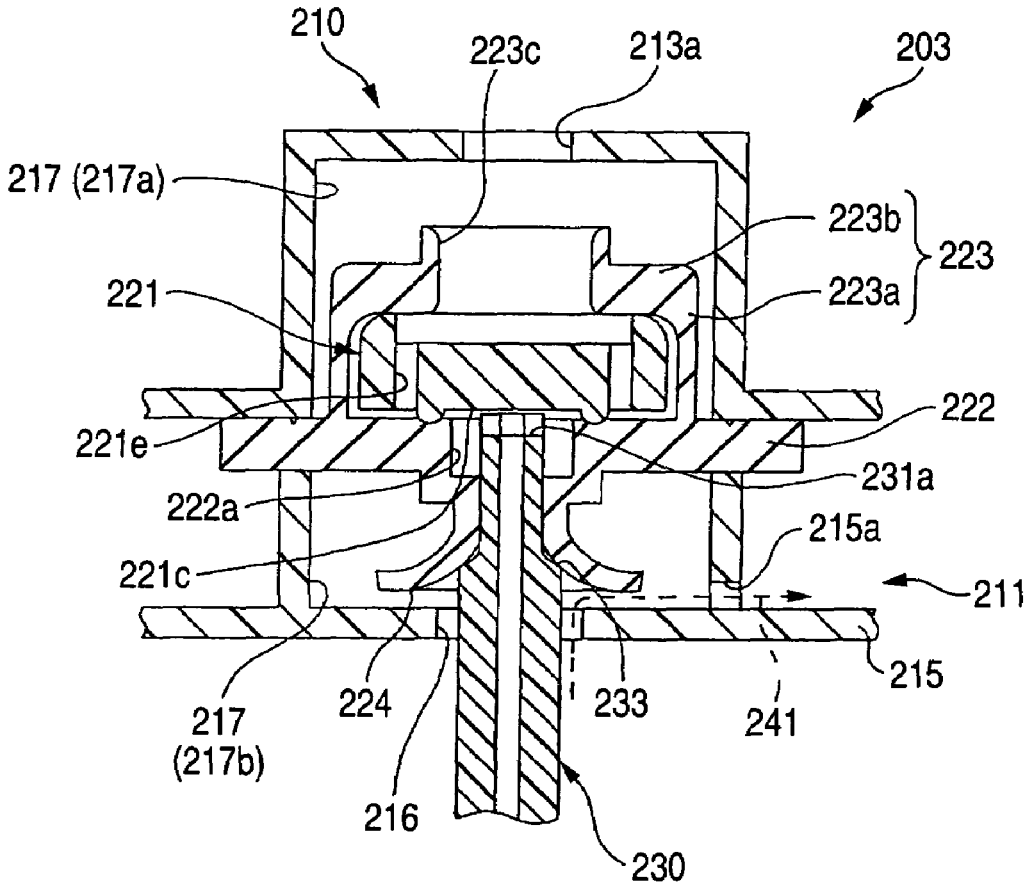
FIG. 21 is an enlarged view of the valve mechanism during an operation of attaching the ink cartridge.
Figure 22:
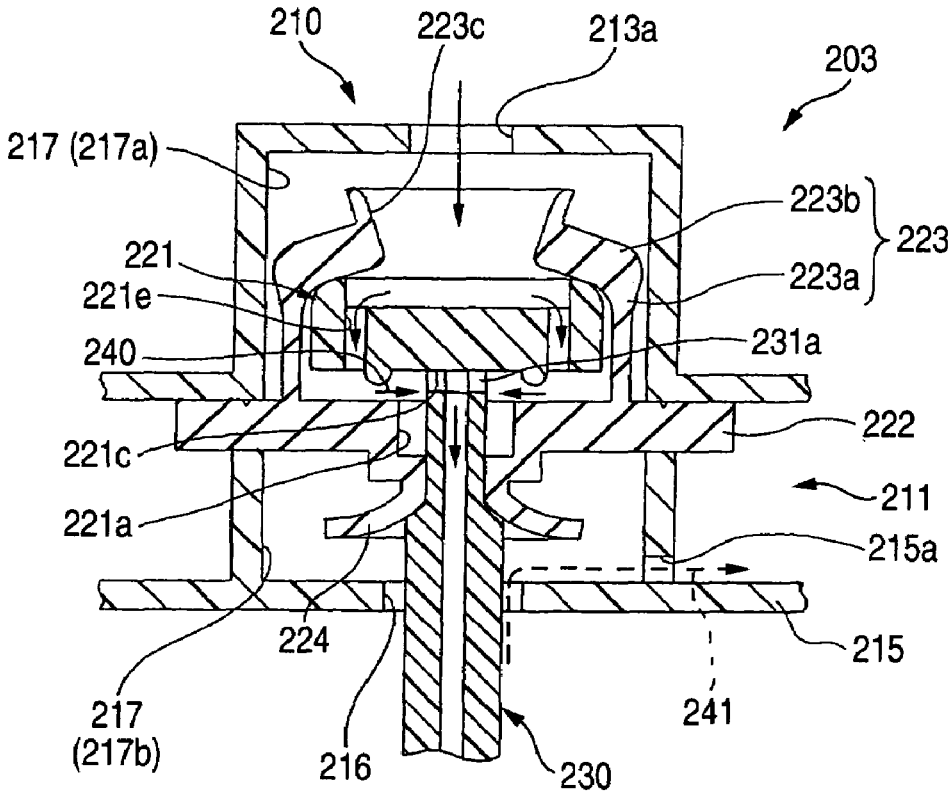
FIG. 22 is an enlarged view of the valve mechanism in a state where the operation of attaching the ink cartridge is completed.

The atmospheric air path opening-closing portion 224 downward protrudes so as to be continuous to the through hole 222*a* of the valve seat portion 222, and is formed into a cylindrical shape in which the diameter is larger as further downward advancing. As shown in FIG. 20, in a state where the ink supply pipe 230 is not inserted into the through hole 222*a*, the lower end of the atmospheric air path opening-closing portion 224 butts against the cover member 202 to close a path between the atmospheric air communicating hole 215*a* and the insertion hole 216, i.e., the atmospheric air path 241. By contrast, as shown in FIGS. 21 and 22, in a state where the ink supply pipe 230 is inserted into the through hole 222*a*, a lower end portion of the atmospheric air path opening-closing portion 224 is elastically deformed in a direction along which the lower end portion of the opening-closing portion 224 is separated from the cover member 202, whereby the atmospheric air path 241 is opened.

The valve element 221 has: a basal portion 221*a* which butts against the valve seat portion 222; and a valve side wall portion 221*b* having a short cylindrical shape which upward extends from an outer peripheral side portion of the basal portion 221*a*. A pressing face 221*c* which is pressed in an upward direction (along which the ink path is opened) by the tip end of the ink supply pipe 230, and an annular projection 221*d* which is projected toward the valve seat portion 222 are formed on the lower face (the end face opposed to the valve seat portion 222) of the basal portion 221*a*. The valve element 221 is urged toward the valve seat portion 222 by the urging portion 223. In a state where the annular projection 221*d* is in close contact with the upper face of the valve seat portion 222, the through hole 222*a* of the valve seat portion 222 is blocked by the valve element 221, and the ink path 240 is closed. A communicating hole 221*e* which allows upper and lower spaces of the valve element 221 to communicate with each other is formed in a portion of the basal portion 221*a* which is outside the annular projection 221*d* and inside the valve side wall portion 221*b*.

Figure 23:
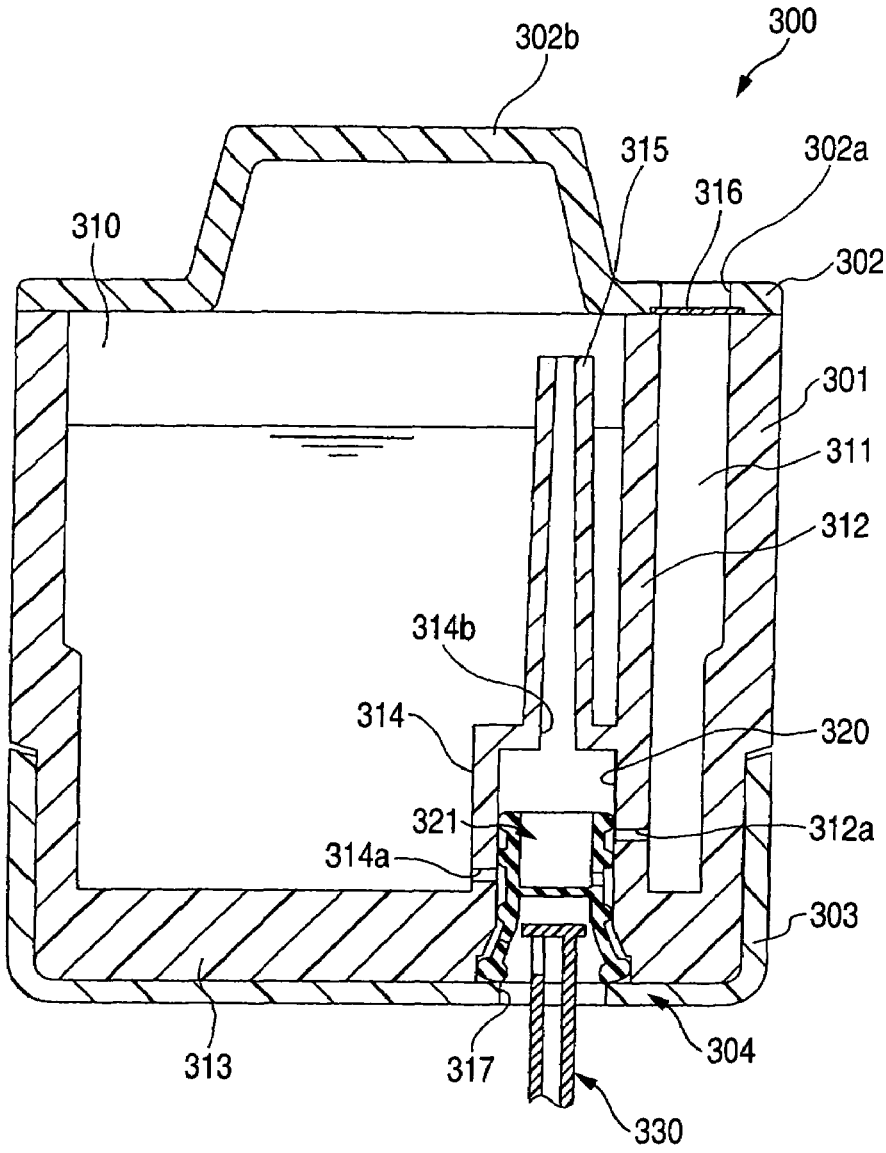
FIG. 23 is a longitudinal sectional view of an ink cartridge of a third embodiment.

When the ink supply pipe 230 is inserted into the through hole 222*a* during a process of attaching the ink cartridge 200 as shown in FIG. 23, the valve element 221 is pushed up against the urging force of the urging portion 223 by the tip end of the ink supply pipe 230, to be upward moved while deforming the urging portion 223. As a result, the annular projection 221*d* of the valve element 221 is separated from the valve seat portion 222, and the ink path 240 is opened.

The ink supply pipe 230 of the inkjet printer has a small-diameter portion 231 which is on the side of the tip end, and a large-diameter portion 232. A tapered portion 233 (operating portion) through which the small-diameter portion 231 is continuously connected to the large-diameter portion 232 is disposed integrally on an outer peripheral portion of the ink supply pipe 230. An ink inflow port 231*a* which allows the inner path of the ink supply pipe 230 to communicate with the outside is formed in the tip end of the small-diameter portion 231.

Next, the opening and closing operations of the valve mechanism 203 which are conducted during the processes of attaching and detaching the ink cartridge 200 will be described.

As shown in FIG. 20, in a state where the ink cartridge 200 has not yet been attached to the inkjet printer, first, the valve element 221 is downward urged by the urging force of the urging portion 223 to butt against the upper face of the valve seat portion 222, so that the annular projection 221*d* is in close contact with the valve seat portion 222. As a result, the through hole 222*a* is closed by the valve element 221, and the ink path 240 is closed. Moreover, the lower end of the atmospheric air path opening-closing portion 224 butts against the cover member 202, and also the atmospheric air path 241 is closed by the atmospheric air path opening-closing portion 224.

When, in this state, the ink supply pipe 230 is inserted through the insertion hole 216 into the cartridge body 201, the small-diameter portion 231 of the ink supply pipe 230 is first inserted into the through hole 222*a* as shown in FIG. 21, and the tapered portion 233 butts against a root portion of the atmospheric air path opening-closing portion 224. In accordance with the operation of inserting the ink supply pipe 230, the atmospheric air path opening-closing portion 224 is pushed up by the tapered portion 233, and the lower end of the atmospheric air path opening-closing portion 224 is separated from the cover member 202. Therefore, the atmospheric air path 241 which elongates from the insertion hole 216 to the atmospheric air communicating hole 215*a* and the atmospheric air introducing space 211 is opened.

When the ink supply pipe 230 is further inserted, the tip end of the ink supply pipe 230 butts against the pressing face 221*c* formed in the basal portion 221*a* of the valve element 221 to push up the valve element 221 as shown in FIG. 22. At this time, the valve side wall portion 221*b* of the valve element 221 pushes up the projected portion 223*b* of the urging portion 223, and the projected portion 223*b* and the side wall portion 223*a* are elastically deformed. Therefore, the valve element 221 is upward moved against the urging force of the urging portion 223. As a result, the valve element 221 is separated from the upper face of the valve seat portion 222 to open the through hole 222*a*, and the tip end portion of the ink supply pipe 230 upward protrudes from the through hole 222*a*. Therefore, the ink path 240 which elongates from the ink introducing hole 213*a* to the through hole 222*a* via the valve housing hole 217, the opening 223*c*, and the communicating hole 221*e*, so that the ink path 240 communicates with the ink supply pipe 230 and the ink I is supplied to the ink supply pipe 230. At this time, the valve seat portion 222 is in close contact with the outer peripheral portions of the small-diameter portion 231 and the tapered portion 233 of the ink supply pipe 230, thereby preventing the ink I flowing through the ink path 240 from leaking from a portion between the ink supply pipe 230 and the valve seat portion 222.

By contrast, in the case where the ink cartridge 200 is to be detached from the inkjet printer, when the ink supply pipe 230 is extracted from the cartridge body 201, the valve element 221 is downward urged by the urging force of the urging portion 223 to butt against the valve seat portion 222, and the through hole 222*a* is closed, whereby the ink path 240 is closed. Moreover, the lower end of the atmospheric air path opening-closing portion 224 is caused by the elasticity of the portion itself to butt against the cover member 202, and hence also the atmospheric air path 241 is closed.

In the ink cartridge 200, the valve mechanism has a valve seat portion which is disposed in the cartridge body, and in which a through hole is formed, the ink supply pipe being to be inserted into the through hole, the first opening-closing portion is buttable against the valve seat portion from a side of the ink storing space of the cartridge body, to close the through hole, a part of the atmospheric air path is formed on a side opposite to the ink storing space across the valve seat portion, and the second opening-closing portion is disposed to be enabled to open and close the part of the atmospheric air path. When the ink supply pipe is attached to the cartridge body, therefore, the through hole is opened by the first opening-closing portion, so that the ink is supplied to the ink supply pipe passed through the through hole, and a part of the atmospheric air path is opened by the second opening-closing portion, so that atmospheric air is introduced into the ink storing space.

In the ink cartridge 200, the second opening-closing portion protrudes from the valve seat portion to the side opposite to the ink storing space, and is disposed integrally with the valve seat portion, and the second opening-closing portion is elastically deformable in a direction along which the atmospheric air path is opened and closed. When the second opening-closing portion which is disposed integrally with the valve seat portion is elastically deformed, therefore, the part of the atmospheric air path which is formed on the side opposite to the ink storing space across the valve seat portion is opened or closed.

In the ink cartridge 200, in a state where the ink supply pipe is inserted into the through hole, an inner peripheral face of the through hole is in close contact with an outer face of the ink supply pipe. As described above, when the ink supply pipe is inserted into the through hole, the inner peripheral face of the through hole is in close contact with the outer face of the ink supply pipe. During the process of supplying the ink from the ink path to the ink supply pipe, therefore, the ink can be prevented from flowing to the outside.

Next, a third embodiment of the invention will be described.

As shown in FIG. 23, an ink cartridge 300 of the third embodiment has: a cartridge body 301 having an ink storing space 310 which stores an ink; a cover member 302 which covers an upper portion of the cartridge body 301; a cap 303 which is disposed on the a lower end portion of the cartridge body 301; and a valve mechanism 304 that can open and close both an ink path 340 (the solid arrow in FIG. 26) through which the ink is supplied to the inkjet head 2, and an atmospheric air path 341 (the broken arrows in FIG. 26) through which atmospheric air is introduced into the ink storing space 310. Each of the cartridge body 301, the cover member 302, and the cap 303 is made of a synthetic resin.

A wall portion 312 which vertically extends is formed in a right portion of the cartridge body 301 in FIG. 23. The wall portion 312 separates the internal space of the cartridge body 301 into an atmospheric air introducing space 311 on the right side and an ink storing space 310 on the left side. The atmospheric air introducing space 311 communicates with the outside through an atmospheric air introducing port 302*a* formed in the cover member 302. In the ink storing space 310, disposed are a tube 314 which upward protrudes from a bottom wall portion 313 of the cartridge body 301, and a tube 315 which further upward protrudes from the upper end of the tube 314.

A tip end portion of the tube 315 is higher than the ink level in the ink storing space 310.

The cover member 302 is fixed to an upper end portion of the cartridge body 301 by ultrasonic welding or the like. A knob 302*b* which upward protrudes is disposed in the cover member 302. The atmospheric air introducing port 302*a* for introducing atmospheric air into the atmospheric air introducing space 311 is formed in the cover member 302. A gas permeable membrane 316 which does not allow liquid to permeate the membrane and allows only a gas (atmospheric air) to permeate it is disposed in the atmospheric air introducing port 302*a*.

The cap 303 is fixed to the cartridge body 301 by ultrasonic welding or the like so as to cover a lower end portion of the cartridge body 301. An insertion hole 317 which communicates with a valve housing hole 320 of the cartridge body 301, and into which the ink supply pipe 330 is to be inserted is formed in the cap 303. The diameter of the insertion hole 317 is smaller than that of the lower end of the valve housing hole 320.

As shown in FIGS. 24 to 27, the valve mechanism 304 comprises: the valve housing hole 320 which constitutes parts of the ink path 340 and the atmospheric air path 341; and a valve member 321 which is slidably attached into the valve housing hole 320. The valve housing hole 320 is formed by the tube 314 and the bottom wall portion 313. The valve housing hole 320 has: a straight hole portion 320*a*; and a tapered hole portion 320*b* which is continuous to the lower end of the straight hole portion 320*a*, and in which the diameter is larger as further downward advancing. The valve housing hole 320 communicates with a lower portion of the ink storing space 310 through a communicating hole 314*a* (first communicating hole) formed in a side wall portion of the tube 314. The valve housing hole 320 communicates also with an upper portion of the ink storing space 310 through a communicating hole 314*b* (third communicating hole) formed in an upper wall portion of the tube 314, and the tube 315. Furthermore, the valve housing hole 320 communicates with the atmospheric air introducing space 311 through a communicating hole 312*a* (fifth communicating hole) formed in the wall portion 312.

The valve member 321 is made of a material which is elastically deformable, such as synthetic rubber, and formed into a substantially cylindrical shape in which both the ends are opened. A lower end portion of the valve member 321 is formed into tapered shape in which the diameter is larger as further downward advancing. First, second, third, and fourth sealing portions 321*a*, 321*b*, 321*c*, and 321*d* which annularly outward protrude to be in close contact with the inner face of the valve housing hole 320 are disposed on outer peripheral portions of upper and lower end portions, and middle portions of the valve member 321, respectively. A horizontal butting portion 322 against which the tip end of the ink supply pipe 330 is to butt is formed inside a portion between the second and third sealing portions 321*b* and 321*c*. Inside the tapered lower end portion of the valve member 321, an engaging portion 323 which is engageable with a flange portion 330*a* formed in a tip end portion of the ink supply pipe 330 is formed so as to inward protrude in a rib-like shape. The lower end portion of the valve member 321 including the engaging portion 323 is configured so as to be elastically deformable in the diameter-decreasing direction. Alternatively, the engaging portion 323 may be configured so as to annularly protrude. Alternatively, plural engaging portions 323 may be discretely formed at equal circumferential intervals on the inner face of the valve member 321.

A communicating hole 324 (second communicating hole) which allows the valve housing hole 320 and an internal space 326 of the valve member 321 to communicate with each other is formed in a portion between the third and fourth sealing portions 321*c* and 321*d*. A communicating hole 325 (fourth communicating hole) which allows an internal space 327 of the valve member 321 and the valve housing hole 320 to communicate with each other is formed in a portion which is between the second and third sealing portions 321*b* and 321*c*, and which is higher in level than the butting portion 322. The internal space 326 communicating with the communicating hole 324 (second communicating hole), and the internal space 327 communicating with the communicating hole 325 (fourth communicating hole) are vertically separated from each other by the butting portion 322 (partition wall).

Figure 24:
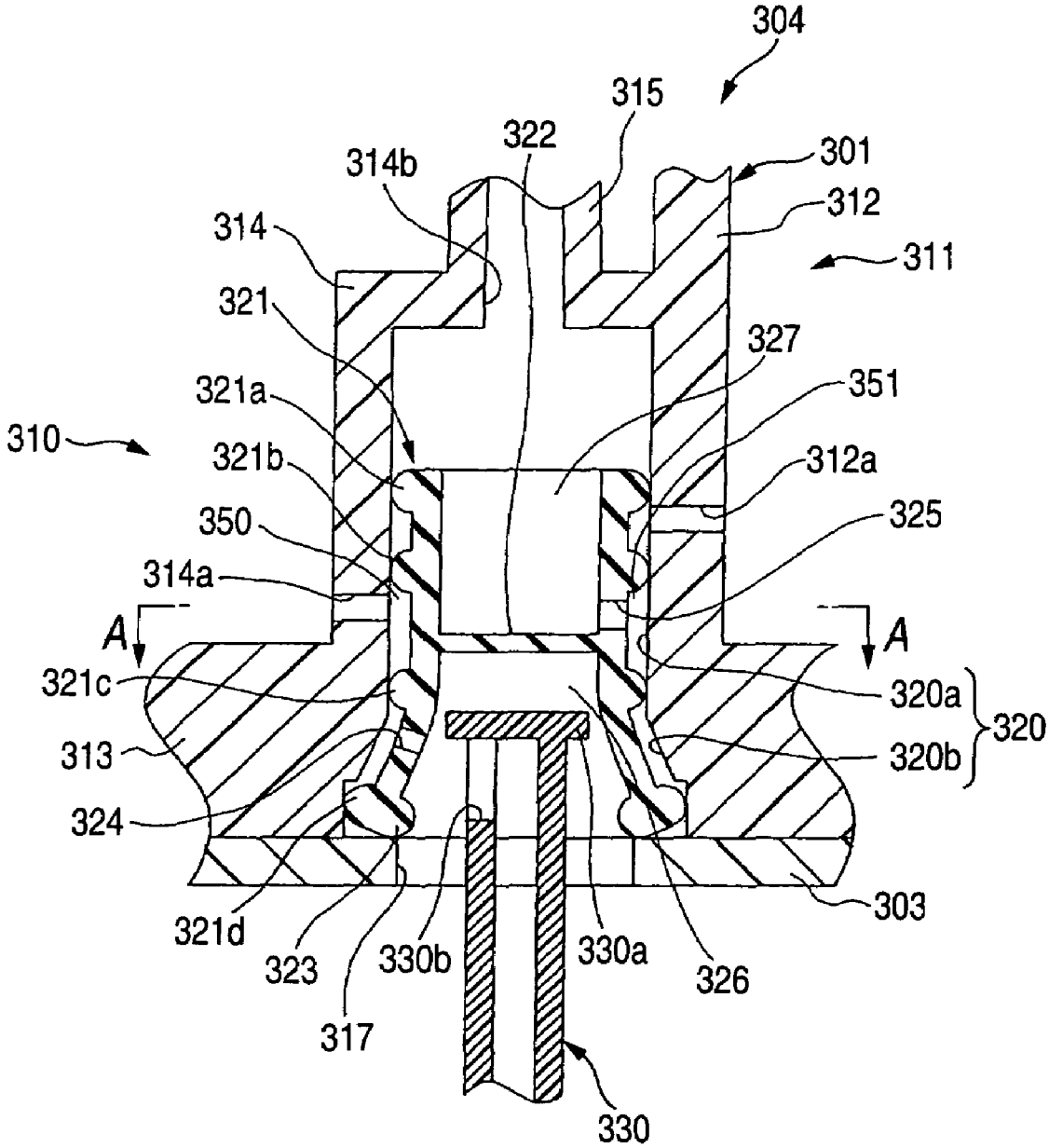
FIG. 24 is an enlarged view of a valve mechanism during an operation of attaching the ink cartridge.
Figure 25:
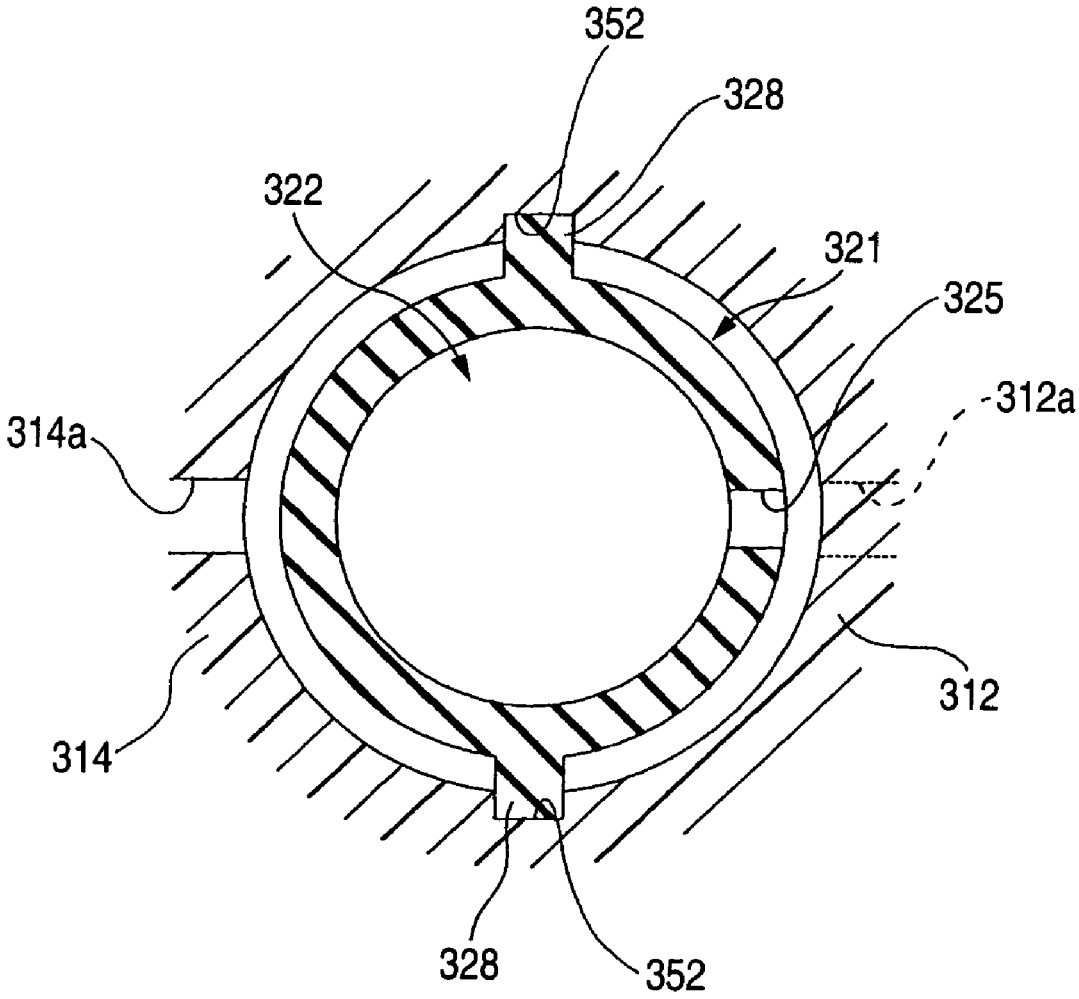
FIG. 25 is a sectional view taken along the line A-A in FIG. 24.

As shown in FIGS. 24 and 25, two ribs 328 which vertically elongate between the first and third sealing portions 321*a* and 321*c* are formed on an outer peripheral portion of the valve member 321, at positions which are symmetric about the center axis of the valve member 321. In the space between the valve member 321 and the valve housing hole 320, the two ribs 328 separate a space 350 which communicates with the communicating hole 314*a*, and into which the ink flows from a space 351 which communicates with the communicating hole 312*a*, and into which atmospheric air flows. The two ribs 328 are engaged with two vertical grooves 352 which are formed in the inner face of the valve housing hole 320, respectively, thereby preventing the valve member 321 from being rotated in the valve housing hole 320 when the valve member 321 is moved in the valve housing hole 320.

As shown in FIG. 24, the ink supply pipe 330 is made of a synthetic resin, and, in the same manner as the embodiments described above, protrudingly disposed in the attaching portion 4. A flange portion 330*a* is formed in a tip end portion of the ink supply pipe 330. An ink inflow port 330*b* which allows the inner path of the ink supply pipe 330 to communicate with the outside is formed in the vicinity of the flange portion 330*a*. The flange portion 330*a* constitutes an operating portion which slidingly operates the valve member 321 as described later.

Next, the opening and closing operations of the valve mechanism 304 which are conducted during the processes of attaching and detaching the ink cartridge 300 will be described.

As shown in FIG. 24, in a state where the ink cartridge 300 has not yet been attached to the inkjet printer, first, the valve member 321 is positioned near the insertion hole 317 in the valve housing hole 320, and the lower end portion of the valve member 321 is placed inside the tapered hole portion 320*b* of the valve housing hole 320, and increased in diameter. The communicating hole 314*a* communicating with the ink storing space 310 is placed between the second and third sealing portions 321*b* and 321*c*, whereby the ink path 340 is closed. Moreover, the communicating hole 312*a* communicating with the atmospheric air introducing space 311 is placed between the first and second sealing portions 321*a* and 321*b*, whereby also the space in the tube 315, i.e., the atmospheric air path 341 is closed with respect to the communicating hole 312*a*. At this time, although both the communicating hole 314*a* on the side of the ink storing space 310, and the communicating hole 325 on the atmospheric air introduction side are positioned between the second and third sealing portions 321*b* and 321*c*, the ink is prevented from flowing into the communicating hole 325, by the two ribs 328 which block communication between the holes.

Figure 26:
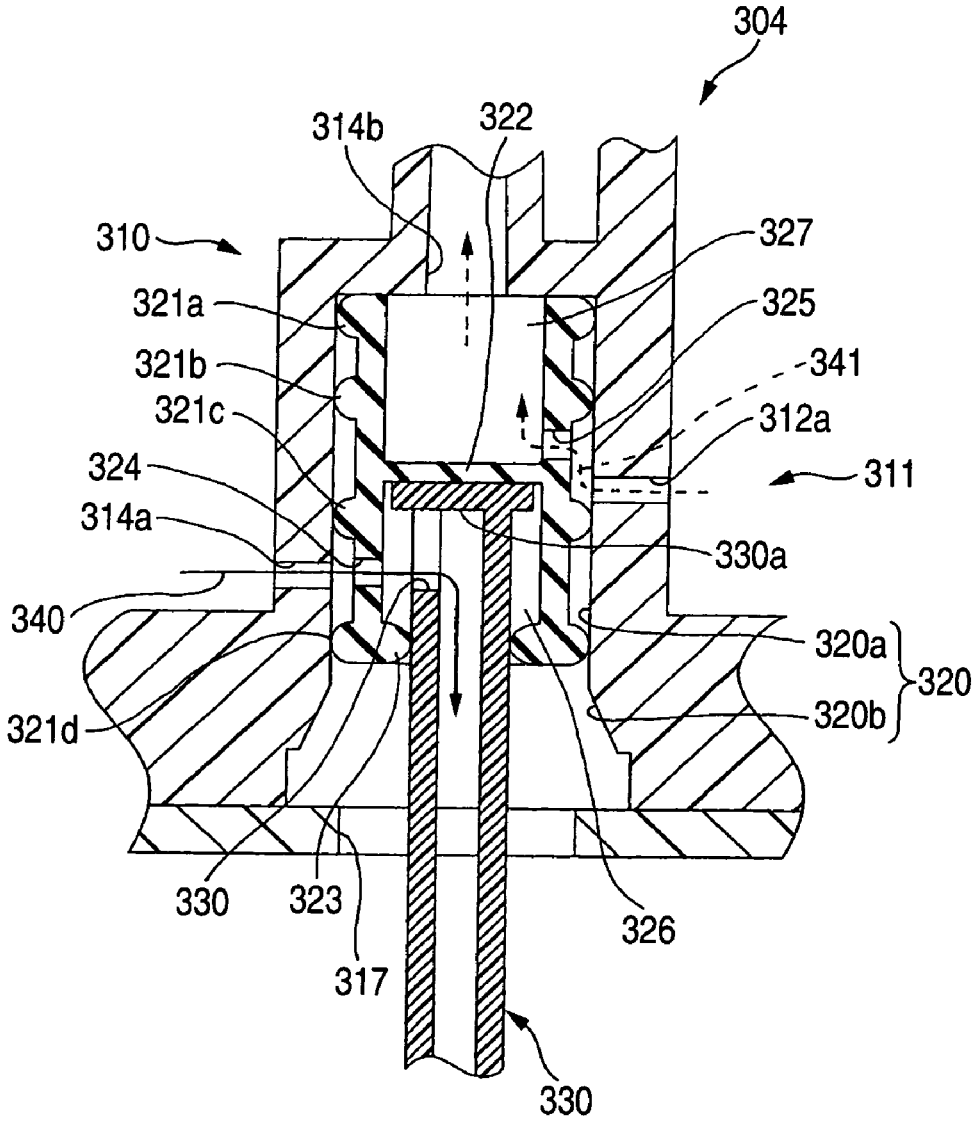
FIG. 26 is an enlarged view of the valve mechanism in a state where the operation of attaching the ink cartridge is completed.

When, in this state, the ink supply pipe 330 is inserted through the insertion hole 317 into the cartridge body 301, the flange portion 330*a* of the ink supply pipe 330 is inserted into the internal space 326 without interfering with the engaging portion 323 of the valve member 321 as shown in FIG. 26 because the diameter of the lower end portion of the valve member 321 is increased. The upper face of the flange portion 330*a* of the ink supply pipe 330 butts against the lower face of the butting portion 322 of the valve member 321, and the valve member 321 is pushed up by the ink supply pipe 330 until the tubular member butts against the upper wall portion of the tube 314. At this time, the tapered lower end portion of the valve member 321 is gradually elastically deformed in the diameter-decreasing direction along the tapered hole portion 320*b*, and the fourth sealing portion 321*d* formed in the lower end portion of the valve member 321 is in close contact with the straight hole portion 320*a*.

Moreover, the engaging portion 323 is in close contact with the outer periphery of the ink supply pipe 330 to seal the lower internal space 326 with respect to the outside, and the internal space communicates with the ink inflow port 330*b*.

The communicating hole 314*a* communicating with the ink storing space 310 is placed between the third and fourth sealing portions 321*c* and 321*d*, and the communicating hole 324 of the valve member 321 communicates with the communicating hole 314*a* of the tube 314. Namely, the ink path 340 which elongates from the ink storing space 310 to the internal space 326 of the valve member 321 via the communicating hole 314*a*, the valve housing hole 320, and the communicating hole 324 is opened, and the ink path 340 communicates with the ink supply pipe 330 through the ink inflow port 330*b*. At the same time, the communicating hole 312*a* communicating with the atmospheric air introducing space 311 is placed between the second and third sealing portions 321*b* and 321*c*, and the communicating hole 325 of the valve member 321 communicates with the communicating hole 312*a* of the wall portion 312. Namely, the atmospheric air path 341 which elongates from the tube 315 to the communicating hole 312*a* via the upper internal space 327 of the valve member 321, the communicating hole 325, and the valve housing hole 320 in the outer periphery of the valve member 321 is opened to the outside. Therefore, atmospheric air is introduced from the atmospheric air introducing space 311 into the upper portion of the ink storing space 310, and the ink I in the ink storing space 310 is supplied to the ink supply pipe 330. At this time, as shown in FIG. 26, the internal space 326 which communicates with the communicating hole 314*a*, and into which the ink flows is separated from the internal space 327 which communicates with the communicating hole 312*a*, and into which the atmospheric air flows, by the partition wall formed by the butting portion 322. Therefore, the ink does not flow into the internal space 327.

Figure 27:
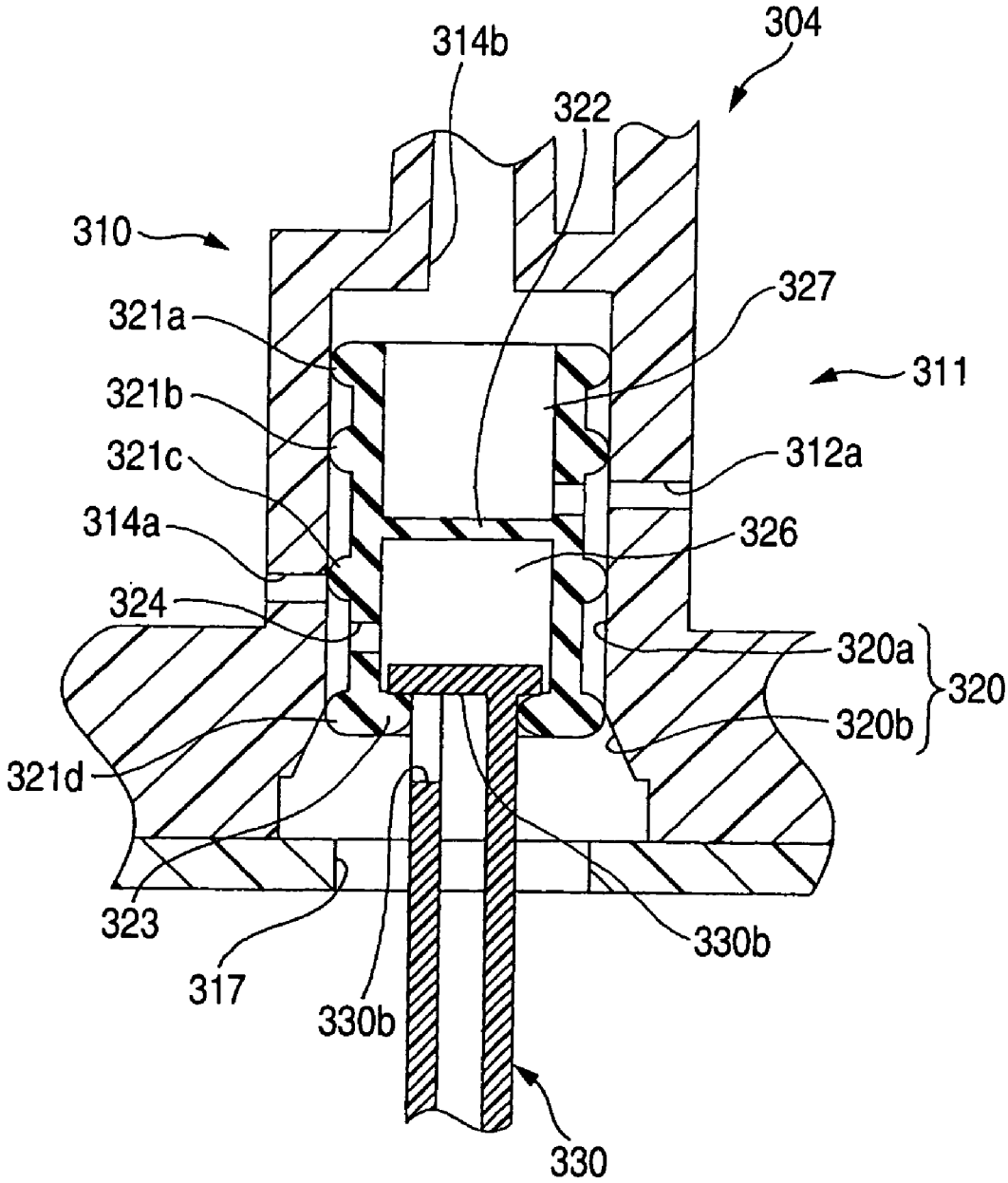
FIG. 27 is an enlarged view of the valve mechanism during an operation of detaching the ink cartridge.

By contrast, in the case where the ink cartridge 300 is to be detached from the inkjet printer, when the ink supply pipe 330 is extracted from the cartridge body 301, the flange portion 330*a* of the ink supply pipe 330 is engaged with or butts against the engaging portion 323 formed in the lower end portion of the valve member 321 as shown in FIG. 27. Therefore, the valve member 321 is downward moved integrally with the ink supply pipe 330. As the engaging portion 323 is further moved along the tapered hole portion 320*b*, however, the engaging portion is gradually further elastically deformed in the diameter-increasing direction to return to its original shape. Therefore, the engagement state between the engaging portion 323 and the flange portion 330*a* is cancelled, and the valve member 321 is engagingly held by the cover member 302, so that only the ink supply pipe 330 is extracted to the outside of the cartridge body 301.

In the ink cartridge 300, the valve mechanism has: a valve housing hole which is formed in the cartridge body 301, and which constitutes parts of the ink path and the atmospheric air path; and the valve member in which the first and second opening-closing portions are formed into an integral cylindrical shape, and into which a tip end portion of the ink supply pipe is to be inserted, the valve member is slidably attached into the valve housing hole, and the valve member has: a butting portion against which, when a tip end portion of the ink supply pipe is inserted into the valve member, a tip end of the ink supply pipe butts to move the valve member in a direction along which the ink path and the atmospheric air path are opened; and an engaging portion with which, when the ink supply pipe is extracted, the tip end portion of the ink supply pipe is engaged to move the valve member in a direction along which the ink path and the atmospheric air path are closed.

In the ink cartridge 300, when the tip end portion of the ink supply pipe is inserted into the tubular valve member, the tip end of the ink supply pipe butts against the butting portion of the valve member, and, in conjunction with the operation of inserting the ink supply pipe, the valve member is moved to open the ink path and the atmospheric air path. By contrast, when the ink supply pipe is extracted from the valve member, the tip end portion of the ink supply pipe is engaged with the engaging portion of the valve member, and, in conjunction with the operation of detaching the ink supply pipe, the valve member is moved to close the ink path and the atmospheric air path.

In the ink cartridge 300, the engaging portion is disposed in an end portion of the valve member on a side into which the ink supply pipe is to be inserted, and the engaging portion is elastically deformable in a diameter-increasing or diameter-decreasing direction of the valve member. By means of the configuration in which the diameter of the engaging portion disposed in the end portion of the valve member can be increased or decreased as described above, the ink supply pipe can be inserted into or extracted from the valve member.

In the ink cartridge 300, the ink path has: a first communicating hole which allows the ink storing space in the cartridge body and the valve housing hole to communicate with each other; and a second communicating hole which allows the valve housing hole and the internal space of the valve member to communicate with each other, the atmospheric air path has: a third communicating hole which allows an outside of the cartridge body and the valve housing hole to communicate with each other; a fourth communicating hole which allows the valve housing hole and the internal space of the valve member to communicate with each other; and a fifth communicating hole which allows the valve housing hole and the ink storing space in the cartridge body to communicate with each other, and the valve member has a partition wall which, in the internal space, separates a portion communicating with the second communicating hole from a portion communicating with the fourth communicating hole.

The ink stored in the ink storing space of the cartridge body flows into the valve housing hole through the first communicating hole. Thereafter, the ink enters the internal space of the valve member through the second communicating hole, and then flows from the internal space to the ink supply pipe. The atmospheric air outside the cartridge body flows into the valve housing hole through the third communicating hole. Thereafter, the atmospheric air enters the internal space of the valve member through the fourth communicating hole, and then flows into the ink storing space through the fifth communicating hole. In the internal space of the valve member, the portion into which the ink is to flow from the second communicating hole is separated by the partition wall from that in to which atmospheric air is to flow from the fourth communicating hole. Therefore, the atmospheric air does not enter the ink path, and the ink does not enter the atmospheric air path.

Next, a modification of the third embodiment will be described. An ink cartridge of the modification is different from the third embodiment in the shape of the valve member. In the following description, the components which are configured in the same manner as those of the third embodiment are denoted by the same reference numerals, and their description is often omitted.

Figure 28:
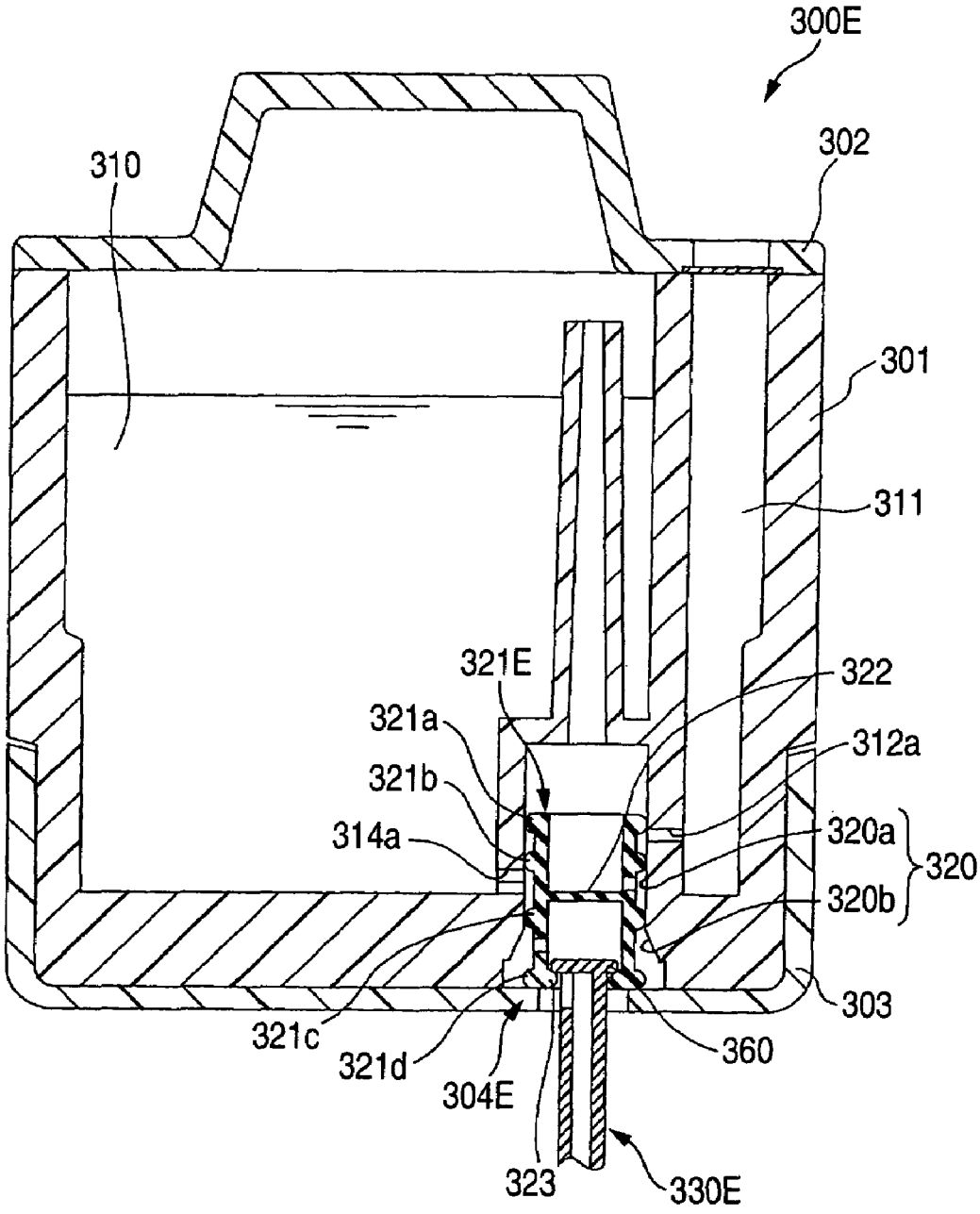
FIG. 28 is a longitudinal sectional view of an ink cartridge of a modification of the third embodiment.

As shown in FIG. 28, in the same manner as the third embodiment, an ink cartridge 300E comprises: the cartridge body 301; the cover member 302; the cap 303; and a valve mechanism 304E disposed in the cartridge body 301.

The valve mechanism 304E has: the valve housing hole 320 formed in the cartridge body 301; and a valve member 321E which is attached to the valve housing hole 320 so as to be vertically slidable. The valve housing hole 320 has: the straight hole portion 320*a*; and the tapered hole portion 320*b* which is continuous to the lower end of the straight hole portion 320*a*, and in which the diameter is larger as further downward advancing.

The valve member 321E housed in the valve housing hole 320 has a substantially cylindrical shape. Unlike in the valve member 321 of the third embodiment, a lower end portion of the valve member 321E is not formed into a tapered shape. In the same manner as the third embodiment, the first, second, third, and fourth sealing portions 321*a*, 321*b*, 321*c*, and 321*d* are formed on the outer peripheral portion of the valve member 321E. The butting portion 322 against which a flange portion 360 of an ink supply pipe 330E is to butt is formed inside the valve member 321E.

Figure 29:
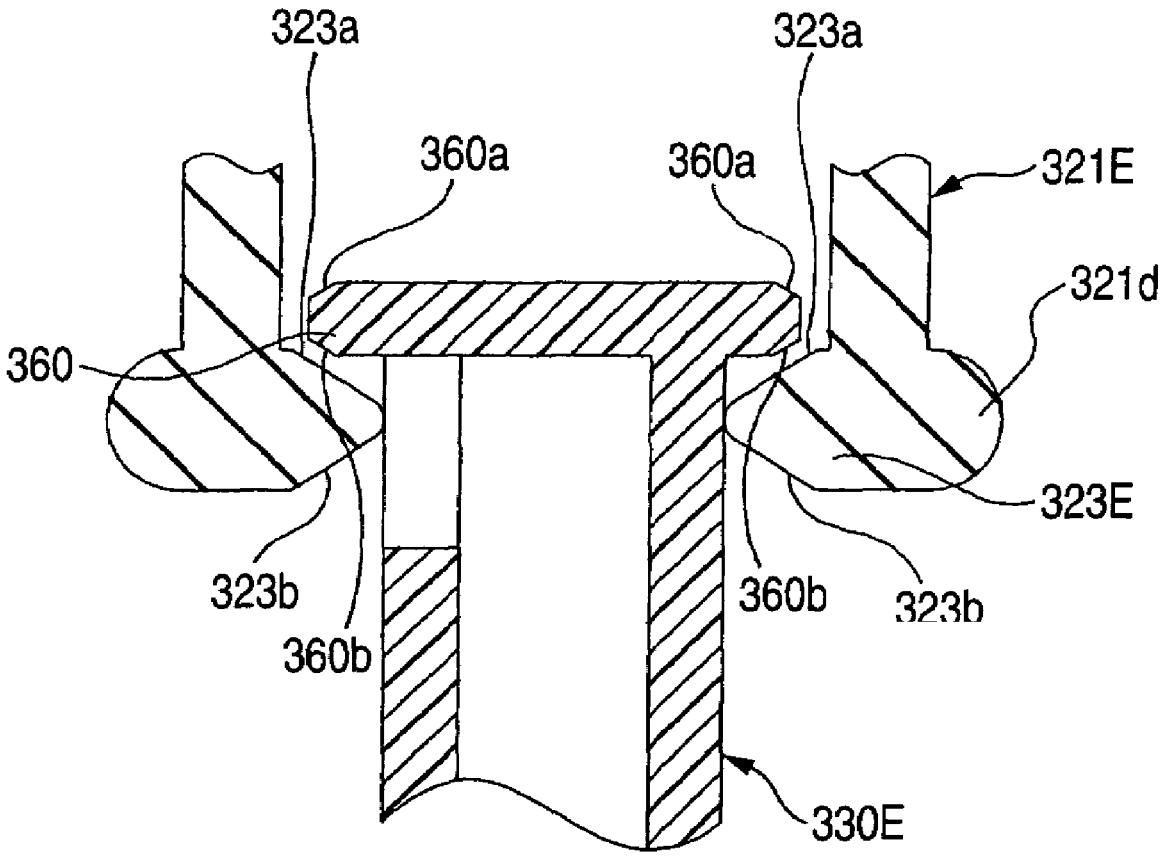
FIG. 29 is an enlarged view of a place where a valve member and an ink supply pipe are engaged with each other.

An engaging portion 323E which inward protrudes is formed inside a lower end portion of the valve member 321E. When the ink supply pipe 330E is inserted into the valve member 321E, and when the ink supply pipe 330E is extracted from the valve member 321E, a lower end portion including the engaging portion 323E is expanded by the flange portion 360 of the ink supply pipe 330E so that the lower end portion is slightly elastically deformable in the diameter-increasing direction. In order to enable the flange portion 360 to be smoothly inserted into and extracted from the valve member 321E, preferably, tapered portions 323*a*, 323*b* are formed in upper and lower sides of an inner portion of the engaging portion 323E as shown in FIG. 29, and tapered portions 360*a*, 360*b* are formed in upper and lower sides of an outer portion of the flange portion 360 of the ink supply pipe 330E. Alternatively, the tapered portions 323*a*, 323*b* or 360*a*, 360*b* may be disposed in only one of the engaging portion 323E and the flange portion 360.

When the ink supply pipe 330E is inserted into the cartridge body 301 of the ink cartridge 300E, the engaging portion 323E is expanded by the flange portion 360 of the ink supply pipe 330E to be elastically deformed in the diameter-increasing direction, and the flange portion 360 is inserted into the internal space of the valve member 321E. In the same manner as the third embodiment, the flange portion 360 then butts against the butting portion 322 to push up the valve member 321E, whereby the ink path and the atmospheric air path are opened.

By contrast, when the ink supply pipe 330E is extracted from the cartridge body 301, the flange portion 360 is engaged with the engaging portion 323E, and the ink supply pipe 330E and the valve member 321E are integrally downward moved, whereby the ink path and the atmospheric air path are closed. When the lower end of the valve member 321E butts against the cap 303, the engaging portion 323E is expanded by the flange portion 360 to be elastically deformed in the diameter-increasing direction, and the flange portion 360 is extracted from the valve member 321E.

In the modification, the engaging portion 323E is elastically deformable in the diameter-increasing direction in the tapered hole portion 320*b* of the valve housing hole 320. It is not necessary to form the valve housing hole into a tapered shape. It is requested only that at least the inner diameter of the lower end portion of the valve housing hole is partially increased.

In the third embodiment and the modification, as described above, the positional relationships among the communicating holes 314*a*, 312*a* and the first to fourth sealing portions 321*a* to 321*d* in the sliding direction of the valve member 321 or 321E are adequately set, whereby the atmospheric air path can be opened faster than the ink path when the ink cartridge is attached to the inkjet printer.

What is claimed is:

1. An ink cartridge comprising:

a cartridge body which has an ink storing space for storing an ink; and a valve mechanism that opens and closes both an ink path which, when an ink supply pipe is attached to the cartridge body, communicates with the ink supply pipe, and an atmospheric air path through which atmospheric air is introduced into the ink storing space, the valve mechanism including a valve member having: a first opening-closing portion which is relatively movable with respect to the cartridge body, and which opens and closes the ink path; and a second opening-closing portion which is relatively movable with respect to the cartridge body, and which opens and closes the atmospheric air path;

wherein when the ink supply pipe is attached to the cartridge body, in conjunction with the attaching operation, the first opening-closing portion opens the ink path, and the second opening-closing portion opens the atmospheric air path.

2. The ink cartridge according to claim 1, wherein the first and second opening-closing portions of the valve member are arranged in a predetermined direction that is coincident with a direction along which the ink supply pipe is attached; and in accordance with an operation of attaching the ink supply pipe, the first and second opening-closing portions are operated sequentially or integrally in the predetermined direction.

3. The ink cartridge according to claim 2, wherein the valve mechanism comprises a valve housing hole which is formed in the cartridge body, and which constitutes parts of the ink path and the atmospheric air path;

one end of the valve housing hole is opened to an outside to enable the ink supply pipe to be inserted, the valve member is housed in the valve housing hole to be movable in an insertion direction of the ink supply pipe;

an ink introduction hole and an atmospheric air communicating hole which allow an interior of the valve housing hole and the ink storing space to communicate with each other are disposed on a side of the ink storing space with respect to the one end of the valve housing hole; and the first and second opening-closing portions of the valve member are placed in correspondence with the ink introduction hole and the atmospheric air communicating hole, respectively.

4. The ink cartridge according to claim 3, wherein the first and second opening-closing portions are configured by separate components, respectively;

the valve mechanism has urging member that urgies the first and second opening-closing portions in a direction along which the ink path and the atmospheric air path are closed;

in a state where the ink supply pipe is not inserted into the valve housing hole, the first opening-closing portion is urged by the urging member to butt against the second opening-closing portion, thereby closing the ink path, and the second opening-closing portion is urged by the urging member to close the atmospheric air path; and in conjunction with the operation of inserting the ink supply pipe into the valve housing hole, the second opening-closing portion is moved to open the atmospheric air path, and the first opening-closing portion is separated from the second opening-closing portion to cause the ink path to communicate with the ink supply pipe.

5. The ink cartridge according to claim 4, wherein the second opening-closing portion has a through hole into which the ink supply pipe is to be inserted;

in a state where the ink supply pipe is not inserted into the through hole, the first opening-closing portion is urged by the urging member to butt against the second opening-closing portion, thereby closing the through hole; and in conjunction with an operation of inserting the ink supply pipe into the through hole, the first opening-closing portion is separated from the second opening-closing portion to cause the ink path to communicate with the ink supply pipe.

6. The ink cartridge according to claim 5, wherein, when the ink supply pipe is extracted from the through hole, the first opening-closing portion is caused by the urging member to butt against the second opening-closing portion, thereby closing the through hole, and the first and second opening-closing portions are then integrally moved to close the atmospheric air path.

7. The ink cartridge according to claim 2, wherein the valve member has an internal space into which the ink supply pipe is to be inserted, and, when the ink supply pipe is inserted into the internal space, the valve member is in close contact with an outer periphery of the ink supply pipe and causes the ink path to communicate with the ink supply pipe.

8. The ink cartridge according to claim 2, wherein the valve mechanism has: a valve housing hole which is formed in the cartridge body, and which constitutes parts of the ink path and the atmospheric air path; and the valve member in which the first and second opening-closing portions are formed into an integral cylindrical shape, and into which a tip end portion of the ink supply pipe is to be inserted;

the valve member is slidably attached into the valve housing hole; and the valve member has: a butting portion against which, when a tip end portion of the ink supply pipe is inserted into the valve member, a tip end of the ink supply pipe butts to move the valve member in a direction along which the ink path and the atmospheric air path are opened; and an engaging portion with which, when the ink supply pipe is extracted, the tip end portion of the ink supply pipe is engaged to move the valve member in a direction along which the ink path and the atmospheric air path are closed.

9. The ink cartridge according to claim 8, wherein the engaging portion is disposed in an end portion of the valve member on a side into which the ink supply pipe is to be inserted, and the engaging portion is elastically deformable in a diameter-increasing or diameter-decreasing direction of the valve member.

10. The ink cartridge according to claim 8, wherein the ink path has: a first communicating hole which allows the ink storing space in the cartridge body and the valve housing hole to communicate with each other; and a second communicating hole which allows the valve housing hole and the internal space of the valve member to communicate with each other;

the atmospheric air path has: a third communicating hole which allows an outside of the cartridge body and the valve housing hole to communicate with each other; a fourth communicating hole which allows the valve housing hole and the internal space of the valve member to communicate with each other; and a fifth communicating hole which allows the valve housing hole and the ink storing space in the cartridge body to communicate with each other; and the valve member has a partition wall which, in the internal space, separates a portion communicating with the second communicating hole from a portion communicating with the fourth communicating hole.

11. The ink cartridge according to claim 4, wherein the first opening-closing portion has a first pressing face which is to be pressed by a tip end portion of the ink supply pipe in a direction along which the ink path is opened, and the second opening-closing portion has a second pressing face which, in conjunction with the operation of attaching the ink supply pipe, is to be pressed in a direction along which the atmospheric air path is opened.

12. The ink cartridge according to claim 1, wherein when the ink supply pipe is attached to the cartridge body, the second opening-closing portion opens the atmospheric air path, and the first opening-closing portion then opens the ink path.

13. The ink cartridge according to claim 12, wherein the first and second opening-closing portions are configured by separate components, respectively; and in conjunction with the operation of attaching the ink supply pipe, the first and second opening-closing portions are integrally moved to open the atmospheric air path, and the first opening-closing portion is then separated from the second opening-closing portion to open the ink path.

14. The ink cartridge according to claim 1, wherein the valve mechanism comprises a valve seat portion which is disposed in the cartridge body, and in which a through hole is formed, the ink supply pipe being to be inserted into the through hole;

the first opening-closing portion is buttable against the valve seat portion from a side of the ink storing space of the cartridge body, to close the through hole; and a part of the atmospheric air path is formed on a side opposite to the ink storing space across the valve seat portion, and the second opening-closing portion is disposed to open and close the part of the atmospheric air path.

15. The ink cartridge according to claim 14, wherein the second opening-closing portion protrudes from the valve seat portion to the side opposite to the ink storing space, and is disposed integrally with the valve seat portion; and the second opening-closing portion is elastically deformable in a direction along which the atmospheric air path is opened and closed.

16. The ink cartridge according to claim 14, wherein, in a state where the ink supply pipe is inserted into the through hole, an inner peripheral face of the through hole is in close contact with an outer face of the ink supply pipe.

17. The ink cartridge according to claim 1, wherein the valve mechanism includes a valve housing hole that is formed in the cartridge body and constitutes part of the ink path and the atmospheric air path; and the valve member is housed in the valve housing hole to be moveable in an insertion direction of the ink supply pipe.

18. An inkjet printer comprising:

an ink supply pipe;

an ink cartridge including: a cartridge body to which the ink supply pipe is detachably attached, and which has an ink storing space for storing an ink to be supplied to the ink-jet printer via the ink supply pipe; and a valve mechanism that opens and closes both an ink path which, when the ink supply pipe is attached to the cartridge body, communicates with the ink supply pipe, and an atmospheric air path through which atmospheric air is introduced into the ink storing space, the valve mechanism including a valve member having: a first opening-closing portion which is relatively movable with respect to the cartridge body, and which opens and closes the ink path; and a second opening-closing portion which is relatively movable with respect to the cartridge body, and which opens and closes the atmospheric air path; in which when the ink supply pipe is attached to the cartridge body, in conjunction with the attaching operation, the first opening-closing portion opens the ink path, and the second opening-closing portion opens the atmospheric air path; and an operating portion which, in conjunction with an operation of attaching the ink supply pipe to the cartridge body, butts against the second opening-closing portion to move the second opening-closing portion to a position where the atmospheric air path is opened.

19. The inkjet printer according to claim 18, wherein the operating portion is formed integrally with an outer peripheral portion of the ink supply pipe.

20. The inkjet printer according to claim 18, wherein the operating portion is disposed to be movable relative to the ink supply pipe in parallel to an attachment direction of the ink supply pipe; and after, in conjunction with the operation of attaching the ink supply pipe, the operating portion butts against the second opening-closing portion to move the second opening-closing portion to the position where the atmospheric air path is opened, the ink supply pipe moves the first opening-closing portion to a position where the ink path is opened.

21. The inkjet printer according to claim 18, wherein the valve mechanism includes a valve housing hole that is formed in the cartridge body and constitutes part of the ink path and the atmospheric air path; and the valve member is housed in the valve housing hole to be moveable in an insertion direction of the ink supply pipe.

* * * * *